US011635213B2

(12) United States Patent
Hu et al.

(10) Patent No.: US 11,635,213 B2
(45) Date of Patent: Apr. 25, 2023

(54) AIR CONDITIONER INDOOR UNIT, AIR CONDITIONER, AND METHOD FOR CONTROLLING AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Hanjie Hu, Foshan (CN); Liangrui Chen, Foshan (CN); Daijie Peng, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 802 days.

(21) Appl. No.: 16/499,587

(22) PCT Filed: Mar. 28, 2019

(86) PCT No.: PCT/CN2019/080150
§ 371 (c)(1),
(2) Date: Sep. 30, 2019

(87) PCT Pub. No.: WO2020/172940
PCT Pub. Date: Sep. 30, 2020

(65) Prior Publication Data

US 2021/0356142 A1 Nov. 18, 2021

(30) Foreign Application Priority Data

Feb. 25, 2019 (CN) ..... 201910138769.2
Feb. 25, 2019 (CN) ..... 201920239645.9

(51) Int. Cl.
*F24F 1/0014* (2019.01)
*F24F 1/005* (2019.01)

(52) U.S. Cl.
CPC ..... *F24F 1/0014* (2013.01); *F24F 1/005* (2019.02)

(58) Field of Classification Search
CPC ..... F24F 1/0014; F24F 1/005; F24F 13/08; F24F 13/10; F24F 13/14; F24F 13/1413; F24F 13/16; F24F 2013/1473
(Continued)

(56) References Cited

U.S. PATENT DOCUMENTS

2011/0028080 A1* 2/2011 Hopkins ..... F24F 13/1426 454/259
2018/0209687 A1 7/2018 Chun et al.

FOREIGN PATENT DOCUMENTS

CN 103528131 A 1/2014
CN 106918131 A 7/2017
(Continued)

OTHER PUBLICATIONS

Shin, Hae Gyn, KR20140049101 Translation.pdf, "Indoor unit of air conditioner", Apr. 2014, pp. 1-14.*
(Continued)

*Primary Examiner* — Avinash A Savani
*Assistant Examiner* — Ryan L Faulkner
(74) *Attorney, Agent, or Firm* — Anova Law Group PLLC

(57) ABSTRACT

An air conditioner indoor unit includes a housing having an air inlet, a first air outlet, and a second air outlet arranged below the first air outlet, and an air output door assembly arranged at the second air outlet and connected to the housing. At least a portion of the air output door assembly is configured to move relative to the housing to form an air output channel between the at least a portion of the air output door assembly and the housing. The air output channel has a ring-shaped air output end located in front of the second air
(Continued)

outlet. The air conditioner indoor unit further includes an opening-closing mechanism movably mounted at the air output door assembly and configured to open or close an air regulation channel area that includes an upper part of the air output channel.

19 Claims, 15 Drawing Sheets

(58) Field of Classification Search
USPC ..... 454/233
See application file for complete search history.

(56) References Cited

FOREIGN PATENT DOCUMENTS

| | | | | | |
|---|---|---|---|---|---|
| CN | 106958866 | A | | 7/2017 | |
| CN | 206669886 | U | | 11/2017 | |
| CN | 206919348 | U | | 1/2018 | |
| CN | 107835917 | A | | 3/2018 | |
| CN | 108266811 | A | | 7/2018 | |
| CN | 108626791 | A | * | 10/2018 | ..... F24F 1/0011 |
| EP | 3372907 | A2 | | 9/2018 | |
| KR | 20140049101 | | * | 4/2014 | ..... F24F 1/00 |
| KR | 101927885 | B1 | | 12/2018 | |
| WO | 2018038100 | A1 | | 3/2018 | |
| WO | 2018192384 | A1 | | 10/2018 | |

OTHER PUBLICATIONS

Dong, Hui, CN108626791 Translation.pdf, "Wall-mounted air conditioner indoor unit", Oct. 2018, pp. 1-9.*
Yang, Huaibo, CN206669886 Translation.pdf, "Vertical air conditioner indoor unit", Nov. 2017, pp. 1-13.*
Korean Intellectual Property Office (KIPO), The Office Action For KR Application No. 9-5-2021-042402674, dated May 27, 2021, 13 Pages (Translation Included ).
World Intellectual Property Office (WIPO), International Search Report and Written Opinion for PCT/CN2019/080150, dated Nov. 8, 2019, 14 pages (including translation).
Japan Patent Office (JPO), Notice of Reasons for Refusal For JP Application No. 2019-556275, dated Jul. 20, 2021, 10 Pages (Translation Included).
Intellectual Property Office of Korea (IPKR), The Office Action For KR Application No. 10-2019-7030590, dated Nov. 19, 2020, 15 Pages (Translation Included ).
The European Patent Office (EPO), Extended Search Report for EP Application No. 19778418.4, dated May 4, 2020, 9 Pages.

* cited by examiner

AIR CONDITIONER INDOOR UNIT, AIR CONDITIONER, AND METHOD FOR CONTROLLING AIR CONDITIONER

CROSS-REFERENCE TO RELATED APPLICATIONS

The present application is a National Stage Entry under 35 U.S.C. § 371 of International Application No. PCT/CN2019/080150, filed Mar. 28, 2019, which claims priority to and benefit of Chinese Patent Application Nos. 201910138769.2 and 201920239645.9 filed on Feb. 25, 2019, the entire contents of all of which are incorporated herein by reference.

FIELD

The present disclosure relates to the technical field of air handling equipment, in particular to an air conditioner indoor unit, air conditioner and air conditioner control method.

BACKGROUND

As a piece of frequently used air conditioning equipment, the air conditioner is used to regulate the indoor environment temperature (some air conditioners also have the functions of regulating the ambient humidity, purifying the air, etc.). In the relevant technology, when the air conditioner is running, the air outlet direction of the indoor air conditioner is single, resulting in uneven indoor environment temperature. In addition, when air conditioner is running in the heating mode, indoor bottom temperature will be lower so that it will be easy to feel cold at the feet, reducing the comfort.

SUMMARY

The purpose of the present disclosure is to address at least one of the technical problems in the existing technology. Therefore, one of the purposes of the present disclosure is to propose an air conditioner indoor unit which can realize stereoscopic air-out effects and improve the comfort level.

The present disclosure also proposes an air conditioner equipped with the above air conditioner indoor unit.

The present disclosure also proposes a control method for the above air conditioner.

According to embodiment of a first aspect of the present disclosure, the air conditioner indoor unit includes: a housing having an air inlet, a first air outlet and a second air outlet, and the second air outlet being arranged below the first air outlet; an air output door assembly arranged at the second air outlet and connected to the housing, wherein when the air conditioner indoor unit operates, an air output channel is formed between the air output door assembly and the housing, and an air output end of the air output channel is located in front of the second air outlet and has a ring shape, in which a horizontal plane passing through a center of the second air outlet serves as a reference plane; an upper air output channel configured as a part of the air output channel above the reference plane, and a lower air output channel configured as a part of the air output channel below the reference plane, and at least a part of the upper air output channel being configured as a first air regulation channel area; a first opening-closing mechanism configured to open or close the first air regulation channel area and movably mounted to the air output door assembly; a heat exchanger assembly and an air duct assembly both arranged in the housing.

For the air conditioner indoor unit according to embodiments of the present disclosure, when the air conditioner is working, the air output end of the second air outlet has a ring shape so that the air can be discharged all around through the second air outlet, and the air is discharged forwards through the first air outlet, which together realizes the stereoscopic air-out effect of the air conditioner, thereby improving the uniformity of indoor temperature; besides, the first opening-closing mechanism is provided to open or close the first air regulation channel area according to the needs, so that the first air regulation channel area can be opened to improve the cool air volume when the air conditioner is running in the cooling mode, and the air blown from the first air regulation channel area has the function of pushing the cool air up slightly, and the first air regulation channel area can be closed to blow the warm air downwards to the floor through the part of air output end corresponding to the lower air output channel when the air conditioner is running in the heating mode, so as to improve the air temperature at the bottom of the room, thus enhancing the comfort level.

According to some embodiments of the present disclosure, an area ratio of a projection of the first air regulation channel area to a projection of the air output channel in a same plane is valued in a range of $\frac{1}{10}$-$\frac{1}{2}$, and the plane is vertical to a central axis of the second air outlet.

According to some embodiments of the present disclosure, the first opening-closing mechanism is rotatably arranged in the upper air output channel, so as to open or close the first air regulation channel area.

According to some optional embodiments of the present disclosure, the first opening-closing mechanism includes at least one first air deflector rotatably mounted in the first air regulation channel area, so as to open or close the first air regulation channel area.

Further, the first opening-closing mechanism includes: a plurality of first air deflectors arranged in a circumferential direction of the air output end of the air output channel; a first connection rod, the plurality of first air deflectors being rotatably connected to the first connection rod, and the first connection rod being configured to move in a left-right direction, wherein the plurality of first air deflectors are lapped successively when the first opening-closing mechanism closes the first air regulation channel area, and an air flow passage to be passed through by an air flow is formed between two adjacent first air deflectors when the first opening-closing mechanism opens the first air regulation channel area.

According to some embodiments of the present disclosure, the air output door assembly includes: an air output bracket arranged in and connected to the housing; an air output door including a door body and a connection base arranged at the door body, the connection base being connected to the air output bracket, so that the door body is located in front of and separated from the second air outlet, and the air output channel is formed by the air output bracket, the air output door and the housing when the air conditioner indoor unit operates.

According to some optional embodiments of the present disclosure, the first opening-closing mechanism is movable mounted to the air output bracket, so as to open or close the first air regulation channel area.

Further, an annular channel is formed in the air output bracket, and configured as a part of the air output channel, and the first opening-closing mechanism is rotatably arranged in the annular channel, so as to open or close the first air regulation channel area.

According to some optional embodiments of the present disclosure, the air output door is movable between an open position and a closed position in a front-rear direction, so that the door body is located in front of and separated from the second air outlet so as to open the second air outlet when the air output door is located in the open position, and the door body is fitted with the second air outlet to close the second air outlet when the air output door is located in the closed position.

Optionally, one of the air output bracket and the connection base is provided with a guiding groove, and the other one thereof is provided with a guiding part fitted with the guiding groove, in which the guiding part and the guiding groove are movable relative to each other in the front-rear direction.

Optionally, both the guiding groove and the guiding part have a ring shape.

According to some optional embodiments of the present disclosure, the air output door assembly includes a driving mechanism configured to drive the air output door to move in the front-rear direction, and the driving mechanism is arranged at the air output bracket and connected to the connection base.

Optionally, a plurality of driving mechanisms are provided and arranged in a circumferential direction of the connection base.

According to some optional embodiments of the present disclosure, a wall surface of the door body facing the second air outlet is configured as a part of an inner wall surface of the air output channel, at least a part of the wall surface of the door body facing the second air outlet is configured as a flow guiding surface, and the flow guiding surface extends forwards obliquely in a direction from a center of the door body to a periphery of the door body.

According to some embodiments of the present disclosure, the air conditioner indoor unit further includes a door arranged in the housing and configured to move up and down, to open or close the first air outlet.

According to some embodiments of the present disclosure, a third air outlet is formed in the housing, and is located below the second air outlet, and at least a part of the lower air output channel serves as a second air regulation channel area. The air output door assembly further includes: a second opening-closing mechanism configured to open or close the second air regulation channel area and is movably arranged at the air output door assembly.

Optionally, the second opening-closing mechanism is rotatably arranged in the lower air output channel, so as to open or close the second air regulation channel area.

According to embodiments of a second aspect of the present disclosure, the air conditioner includes: an air conditioner indoor unit configured as the air conditioner indoor unit according to the embodiments of the first aspect of the present disclosure; and an air conditioner outdoor unit connected to the air conditioner indoor unit to form a refrigerant cycle.

According to the embodiments of the present disclosure, the air conditioner indoor unit is set as above to realize the stereoscopic air output effect of the air conditioner, enhance the uniformity of indoor temperature, and improve the comfort level by raising the air temperature at the bottom of the room when the air conditioner is running.

In the control method for the air conditioner according to embodiments of a third aspect of the present disclosure, the air conditioner is the air conditioner according to the embodiments of the second aspect of the present disclosure, and the air conditioner has a cooling mode and a heating mode. The control method includes: judging a current operation mode of the air conditioner; controlling the first opening-closing mechanism according to the current operation mode of the air conditioner. When the air conditioner is in the cooling mode, the first opening-closing mechanism is controlled to open the first air regulation channel area, and when the air conditioner is in the heating mode, the first opening-closing mechanism is controlled to close the first air regulation channel area.

According to the control method of the air conditioner according to embodiments of the present disclosure, the air conditioner can have relatively large cool air volume when it is running in the cooling mode; can improve the air temperature at the bottom of the room, thus enhancing the comfort level when it is running in the heating mode.

According to some embodiments of the present disclosure, a third air outlet is formed in the housing, and is located below the second air outlet, at least a part of the lower air output channel is configured as a second air regulation channel area, the air output door assembly further includes a second opening-closing mechanism configured to open or close the second air regulation channel area, and the second opening-closing mechanism is movably arranged a the air output door assembly. When the air conditioner is in the cooling mode, the first opening-closing mechanism is controlled to open the first air regulation channel area and the second opening-closing mechanism is controlled to close the second air regulation channel area. When the air conditioner is in the heating mode, the first opening-closing mechanism is controlled to close the first air regulation channel area and the second opening-closing mechanism is controlled to open the second air regulation channel area.

Additional aspects and benefits of the present disclosure will be presented in the following sections, which will become apparent from the following descriptions or through the practice of the present disclosure.

BRIEF DESCRIPTION OF THE DRAWINGS

The above and/or additional aspects and advantages of the present disclosure will become apparent and easy to be understood from the description of embodiments in combination with the attached drawings below, in which.

REFERENCE NUMERALS

Figure 1:
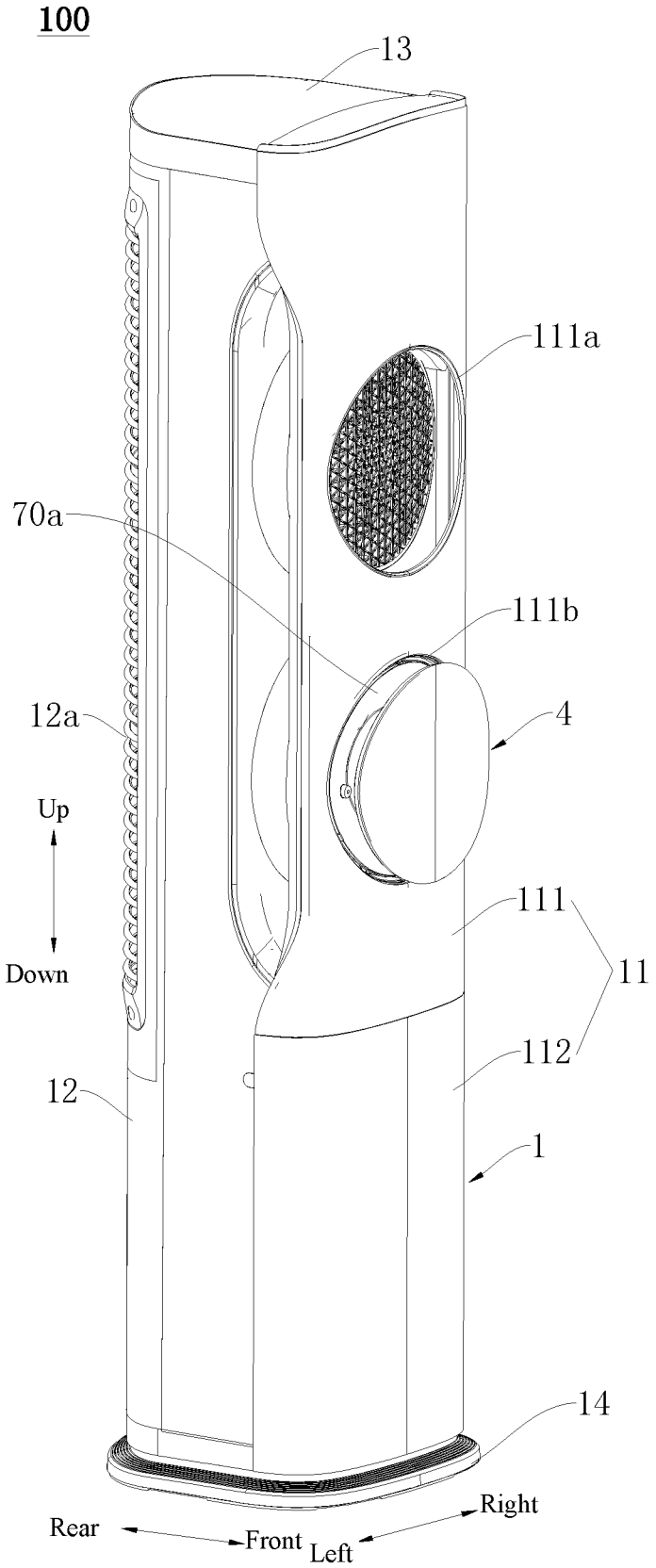
FIG. 1 is a perspective view of the air conditioner indoor unit according to a first embodiment of the present disclosure.

Air conditioner indoor unit 100;

Housing 1; panel assembly 11; upper panel part 111; first air outlet 111*a*; second air outlet 111*b*; third air outlet 111*c*; lower panel part 112; back plate part 12; air inlet 12*a*; head cover part 13; base part 14;

Heat exchanger assembly 2;

Air duct assembly 3; air duct mounting plate 30; first air duct member 31; first air duct 31*a*; first wind wheel 31*b*; first motor 31*c*; second air duct member 32; second air duct 32*a*; second wind wheel 32*b*; second motor 32*c*; third air duct member 33; third air duct 33*a*; third wind wheel 33*b*; third motor 33*c;*

Air output door assembly 4; air output bracket 41; bracket body 411; annular channel 411*a*; mounting part 412; mounting cavity 412*a*; guiding groove 412*b*; connection rib 413; air output door 42; door body 421; flow guiding surface 4211; connection base 422; guiding part 4221; driving mechanism 43;

First opening-closing mechanism 5; first air deflector 51; first connection rod 52;

Second opening-closing mechanism 6; second air deflector 61; second connection rod 62;

Air outlet channel 7*a*; air output end 70*a*; upper air output channel 71*a*; first air regulation channel area 711*a*; lower air output channel 72*a*; second air regulation channel area 721*a;*

Door 8.

DETAILED DESCRIPTIONS

The embodiments of the present disclosure are described in detail below, and examples of the embodiments are shown in the attached drawings, throughout which the identical or similar labels are used to denote the identical or similar elements or elements having identical or similar functions. The embodiments described below by reference to the attached drawings are illustrative and are used only to interpret the present disclosure but should not be construed as restrictions on the present disclosure.

The air conditioner indoor unit 100 according to embodiments of the present disclosure is described as follows with reference to the attached drawing.

Figure 2:
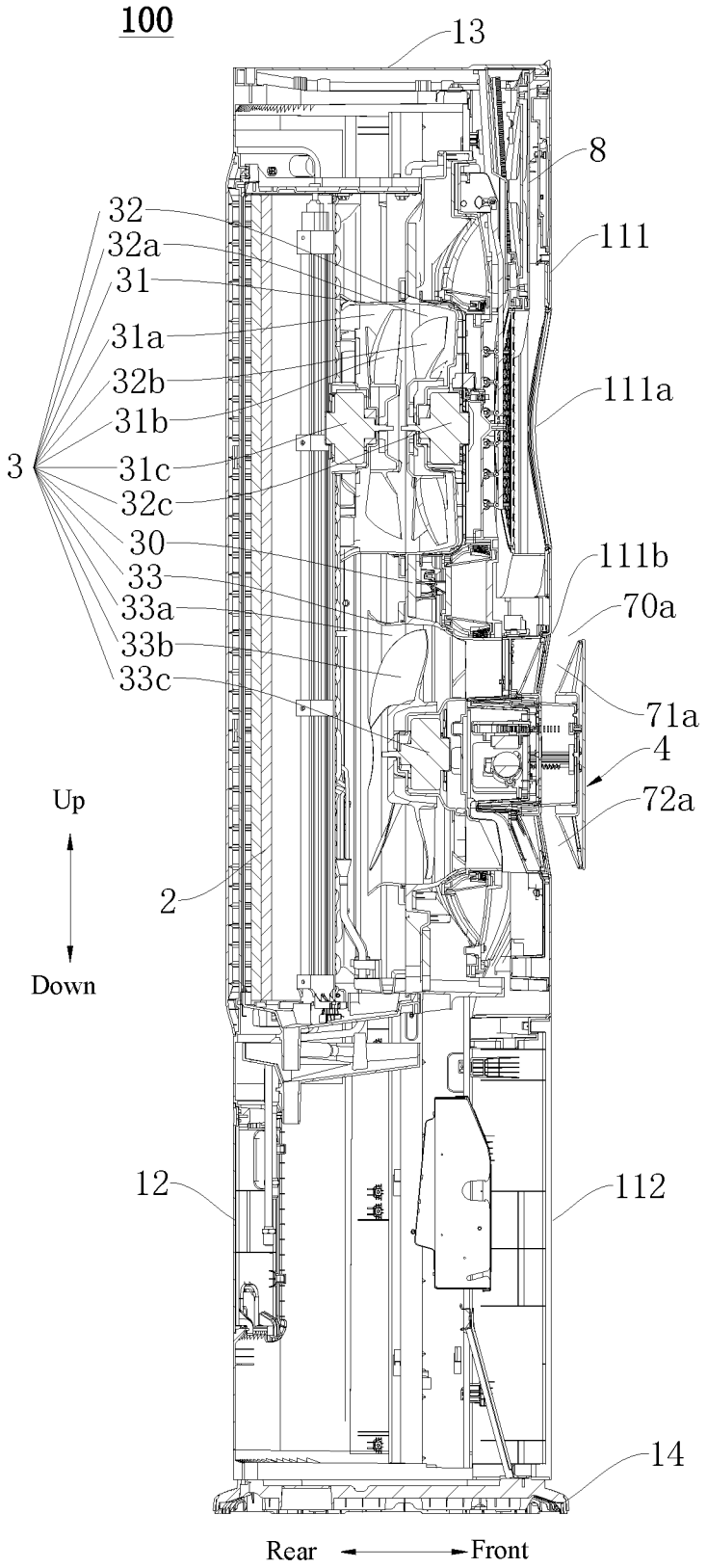
FIG. 2 is a longitudinal cross-sectional view of the air conditioner indoor unit in FIG. 1.

As shown in FIG. 1 and FIG. 2, the air conditioner indoor unit 100 according to embodiments of the first aspect of the present disclosure includes: the housing 1, the air output door assembly 4, the heat exchanger assembly 2, the air duct assembly 3 and the first opening-closing mechanism 5. Optionally, the air conditioner indoor unit 100 can be either floor type or wall-mount type.

Specifically, the housing 1 is provided with the air inlet 12*a*, the first air outlet 111*a* and the second air outlet 111*b*, where the second air outlet 111*b* is located below the first air outlet 111*a*, while both the heat exchanger assembly 2 and the air duct assembly 3 are mounted in the housing 1. When the air conditioner is working, both the first air outlet 111*a* and the second air outlet 111*b* will be opened, so that the air duct assembly 3 drives the air to flow into the housing 1 from the air inlet 12*a*, and the air exchanges heat with the heat exchanger assembly 2; after heat exchange with the heat exchanger assembly 2, the air will be blown out to the room at least through the first air outlet 111*a* and the second air outlet 111*b*, so as to regulate the indoor environment temperature.

For example, as shown in FIG. 1 and FIG. 2, the air conditioner indoor unit 100 is a floor type air conditioner indoor unit, the cross section of the housing 1 is approximately a circle, the housing 1 includes the panel assembly 11 and the back plate part 12 which are mounted in front-rear configuration and is connected to each other, as well as the head cover part 13 and the base part 14 which are mounted at upper and lower sides of the panel assembly 11 respectively, the panel assembly 11 includes the upper panel part 111 and the lower panel part 112; thereby, by configuring the panel assembly 11 to include the upper panel part 111 and the lower panel part 112 which are connected to each other, the structural strength of the panel assembly 11 can be improved. The air inlet 12*a* is formed at the back plate part 12, both the first air outlet 111*a* and the second air outlet 111*b* are formed at the upper panel part 111, and arranged at interval in the up-down direction, and both the heat exchanger assembly 2 and the air duct assembly 3 are mounted in the housing 1, and are arranged in the air flowing direction.

Also as shown in FIG. 2, the air duct assembly 3 includes the air duct mounting plate 30, the first air duct member 31, the first wind wheel 31*b*, the first motor 31*c*, the second air duct member 32, the second wind wheel 32*b*, the second motor 32*c*, the third air duct member 33, the third wind wheel 33*b* and the third motor 33*c*. The first air duct member 31, the second air duct member 32 and the third air duct member 33 are all mounted at the air duct mounting plate 30, where the first air duct member 31 and the second air duct member 32 are arranged successively at opposite sides in the air flowing direction, and the third air duct member 33 is located below the first air duct member 31 and the second air duct member 32. The first air duct member 31 has the first air duct 31*a* in which the first wind wheel 31*b* is mounted, the first motor 31*c* is connected to and located behind the first wind wheel 31*b*; the second air duct member 32 has the second air duct 32*a* which is facing and connected to the first air duct 31*a*, the second wind wheel 32*b* is mounted in the second air duct 32*a*, and the second motor 32*c* is connected to the second wind wheel 32*b* and located in the front side of the same; the third air duct member 33 has the third air duct 33*a* in which the third wind wheel 33*b* is mounted, and the third motor 33*c* is connected to the third wind wheel 33*b* and located in the front side of the same. The first wind wheel 31*b* and the second wind wheel 32*b* supply air to the first air outlet 111*a* when rotating, while the third wind wheel 33*b* supplies air to the second air outlet 111*b* when rotating.

Optional, each of the first wind wheel 31*b*, the second wind wheel 32*b* and the third wind wheel 33*b* can be axial-flow wind wheel or oblique-flow wind wheel.

In this case, the rotation directions of the first wind wheel 31*b* and the second wind wheel 32*b* may be opposite, and their air blowing directions may be same, both toward the first air outlet 111*a*. If the first wind wheel 31*b* rotates counterclockwise, the second wind wheel 32*b* will rotate clockwise; vice versa. Besides, when the first wind wheel 31*b* and the second wind wheel 32*b* rotate, the air produced will flow toward the first air outlet 111*a*.

The first wind wheel 31*b*, the first motor 31*c*, the second wind wheel 32*b* and the second motor 32*c* constitute the counter-rotating fan, which means that the tilting direction of the blade of the first wind wheel 31*b* is opposite to that of the second wind wheel 32*b*, and the first wind wheel 31*b* and the second wind wheel 32*b* guide each other in the direction of air flow, which reduces (when the first wind wheel 31*b* and the second wind wheel 32*b* rotate at different speeds) or eliminates (when the first wind wheel 31*b* and the second wind wheel 32*b* rotate at the same speed) the tangential rotation speed of airflow (that is, the dynamic pressure is converted to static pressure), and improves the work efficiency of the counter-rotating fan; and the air from two wind wheels flows to the direction of air outlet, so as to realize long-distance air supply. It should be noted that the counter-rotating fan could realize air supply for longer distance no matter whether the first wind wheel 31*b* and the second wind wheel 32*b* rotate at the different speeds or the same speed, as compared with the single cross-flow fan, axial-flow fan or diagonal fan.

Secondly, the delivery range of the air can be expanded when the first wind wheel 31*b* and the second wind wheel 32*b* rotate at the different speeds. Since when one wind wheel rotates at higher speed and another wind wheel rotates at lower speed, the wind wheel of higher speed plays a leading role, and deviates from the rotation axis according to air outlet angle of the blades of single-stage axial-flow or diagonal fan, so that the axial wind wheel or oblique wind wheel itself has air distribution effect; thus, the angle range of the air from the first air outlet 111*a* will be expanded to realize air supply in a larger angle range. Besides, on the basis of the air distribution effect of the axial wind wheel or oblique wind wheel itself, the rotation speeds of the first wind wheel 31*b* and the second wind wheel 32*b* can be adjusted according to the demands to make them rotate at different speeds, thus realizing gentle breeze or breezeless air supply, and preventing the cool air being blown directly to the users through the first air outlet 111*a* that causes bad experience to the user. Therefore, the air conditioner indoor unit 100 according to embodiments of the present disclosure can realize gentle breeze or breezeless air supply without the air deflector with micro holes, so that the air loss is small.

It should be noted that the motor corresponding to either wind wheel of the counter-rotating fan may be deactivated while another wind wheel still supplies air forwards to the side of the air outlet in order to realize wide-angle air supply and breezeless air supply. In addition, either wind wheel of the counter-rotating fan can supply air reversely to the inner side of the housing 1 while another wind wheel supplies air forwards for realizing wide-angle air supply and breezeless air supply. In this case, "forward air supply" means that the air is blown out from the air outlet under the effect of the wind wheel, while "reverse air supply" means that the air is blown toward the inner side of the housing 1.

The air output door assembly 4 is arranged at the second air outlet 111*b* and is connected to the housing 1; when the air conditioner indoor unit 100 is working, the air output channel 7*a* will be formed between the air output door assembly 4 and the housing 1, the air output end 70*a* of the air output channel 7*a* is located in front of the second air outlet 111*b*, and is formed to have a ring shape; the central axis of the air output end 70*a* of the air output channel 7*a* can extend in the front-rear direction, and the horizontal plane passing through the central point of the second air outlet 111*b* serves as the reference plane. The part of the air output channel 7*a* located above the above-described reference plane is the upper air output channel 71*a*, the part of the air output channel 7*a* located below the above-described reference plane is the lower air output channel 72*a*, at least a part of the upper air output channel 71*a* is the first air regulation channel area 711*a*; for example, only a part or an entirety of the upper air output channel 71*a* can serve as the first air regulation channel area 711*a*.

Thus, when the air conditioner is working, the air will flow through the air output channel 7*a*, and then be blown out to the room through the air output end 70*a* of the air output channel 7*a*, at which point the air can be blown out in the circumferential direction of the second air outlet 111*b*, that is, the air blown from the second air outlet 111*b* can flow all around the second air outlet 111*b*, so that the air can be blown out all around through the second air outlet 111*b*, and the air can be blown forwards through the first air outlet 111*a*, which together enables the air conditioner to have stereoscopic air-out effect and improves the indoor temperature uniformity.

Optionally, the entire above-described air output channel 7*a* can be placed in front of the second air outlet 111*b*, so that the air from the second air outlet 111*b* flows through the air output channel 7*a*, and then is blown out to the room through the air output end 70*a* of the air output channel 7*a*; the air output channel 7*a* may be located partially in the housing 1; at this moment, the space in the second air outlet 111*b* can be regarded as a part of the air output channel 7*a*; another part of the air output channel 7*a* penetrates through the second air outlet 111*b* and extends to the front side of the second air outlet 111*b*, so that the air after heat exchange in the housing 1 will flow through the above-described part of the air output channel 7*a*, then pass through the second air outlet 111*b* and flow out to the part of air output channel 7*a* in front of the second air outlet 111*b*, and finally blown out to the room through the air output end 70*a* of the air output channel 7*a*.

The first opening-closing mechanism 5 is used to open or close the first air regulation channel area 711*a*, and can be mounted at the air output door assembly 4 in a movable manner so that the first air regulation channel area 711*a* can be opened or closed as the first opening-closing mechanism 5 moves. When the first air regulation channel area 711*a* is closed, the part of the air output end 70*a* corresponding to the first air regulation channel area 711*a* will be closed, at which point the air from the second air outlet 111*b* can flow out to the room only through the part of air output end 70*a* excluding the part corresponding to the first air regulation channel area 711*a*; for example, the air can flow out to the room through the part of the air output end 70*a* corresponding to the lower air output channel 72*a*; when the first air regulation channel area 711*a* is opened, the part of the air output end 70*a* corresponding to the first air regulation channel area 711*a* will be opened, at which point the air from the second air outlet 111*b* can flow out to the room through the entire air output end 70*a* corresponding to the entire air output channel 7*a*, which thereby improves the air outlet volume.

Optionally, the first opening-closing mechanism 5 can be mounted at the air output door assembly 4 in a movable manner, at which point the first opening-closing mechanism 5 can be moved to open or close the first air regulation channel area 711*a*; alternatively, the first opening-closing mechanism 5 can be mounted at the air output door assembly 4 in a rotatable manner, at which point the first opening-closing mechanism 5 can be moved to open or close the first air regulation channel area 711*a*.

In this case, when the air conditioner is working, the first opening-closing mechanism 5 can be controlled according to the operation mode of the air conditioner, so as to open or close the first air regulation channel area 711*a*.

Figure 3:
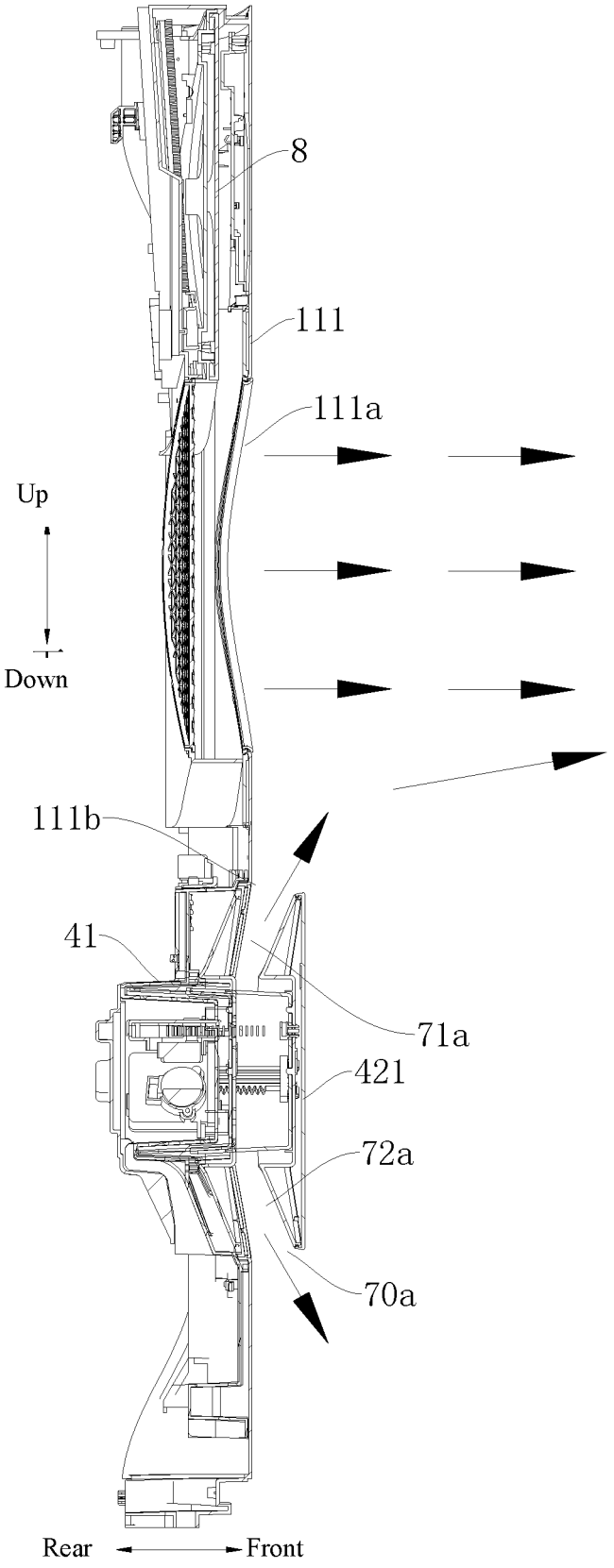
FIG. 3 is a schematic view showing air supply of the air conditioner indoor unit in FIG. 1 when in the cooling mode.
Figure 4:
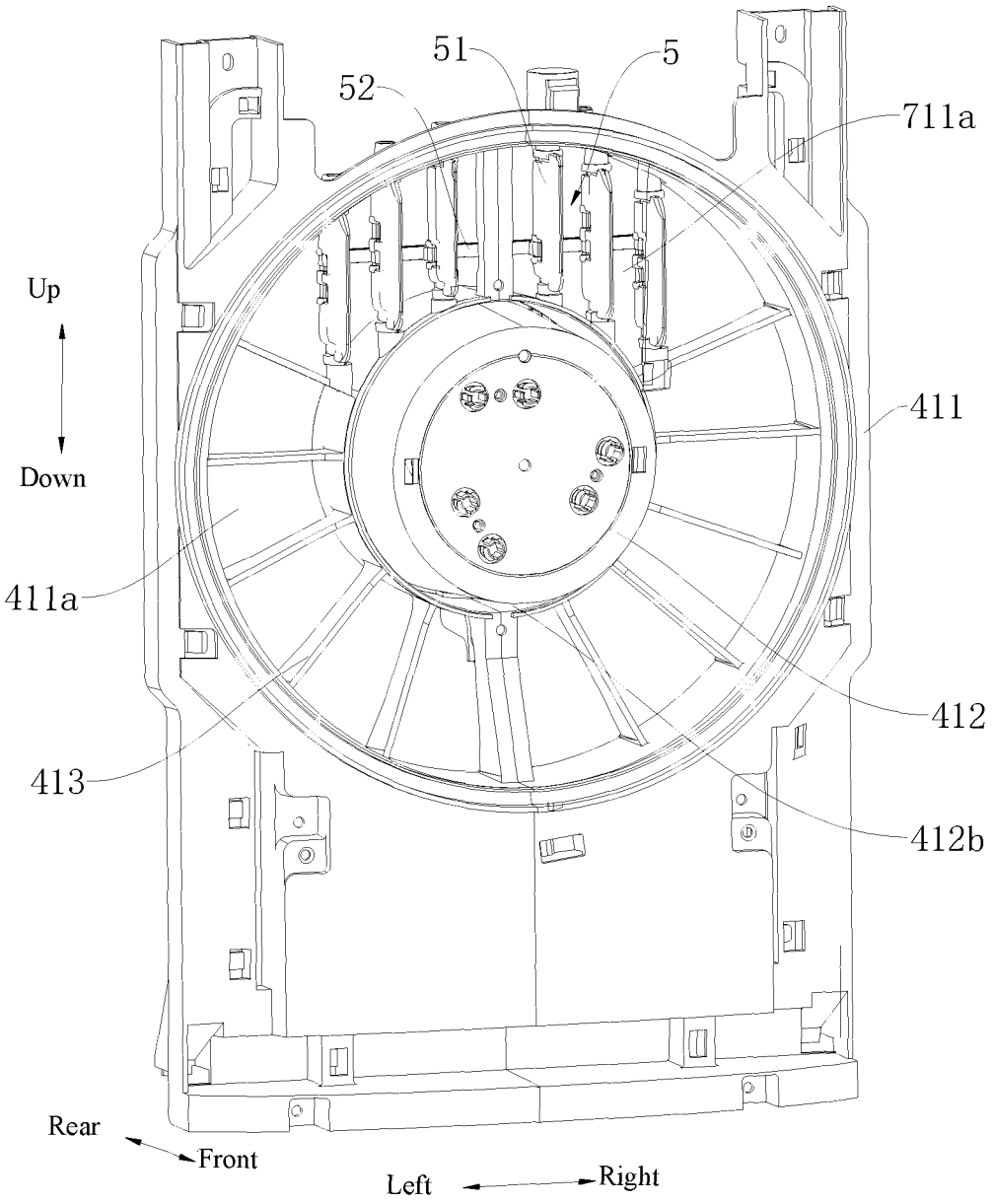
FIG. 4 is a schematic view showing state of the first opening-closing mechanism when the air conditioner indoor unit in FIG. 1 is in the cooling mode.

For example, when the air conditioner is in the cooling mode (as shown in FIG. 3 and FIG. 4, the direction of arrow is the flowing direction of the air), the first opening-closing mechanism 5 can be controlled to open the first air regulation channel area 711*a*; at this moment, the air from the second air outlet 111*b* can flow out to the room through the entire air output end 70*a* corresponding to the entire air output channel 7*a*, which can increase the cool air volume. Besides, the air blown from the upper air output channel 71*a* has the function of pushing the cool air up slightly, and the cool air blown from the upper air output channel 71*a* has the function of pushing the air from the first air outlet 111*a* up slightly, which improves the temperature uniformity further in the cooling mode.

Figure 5:
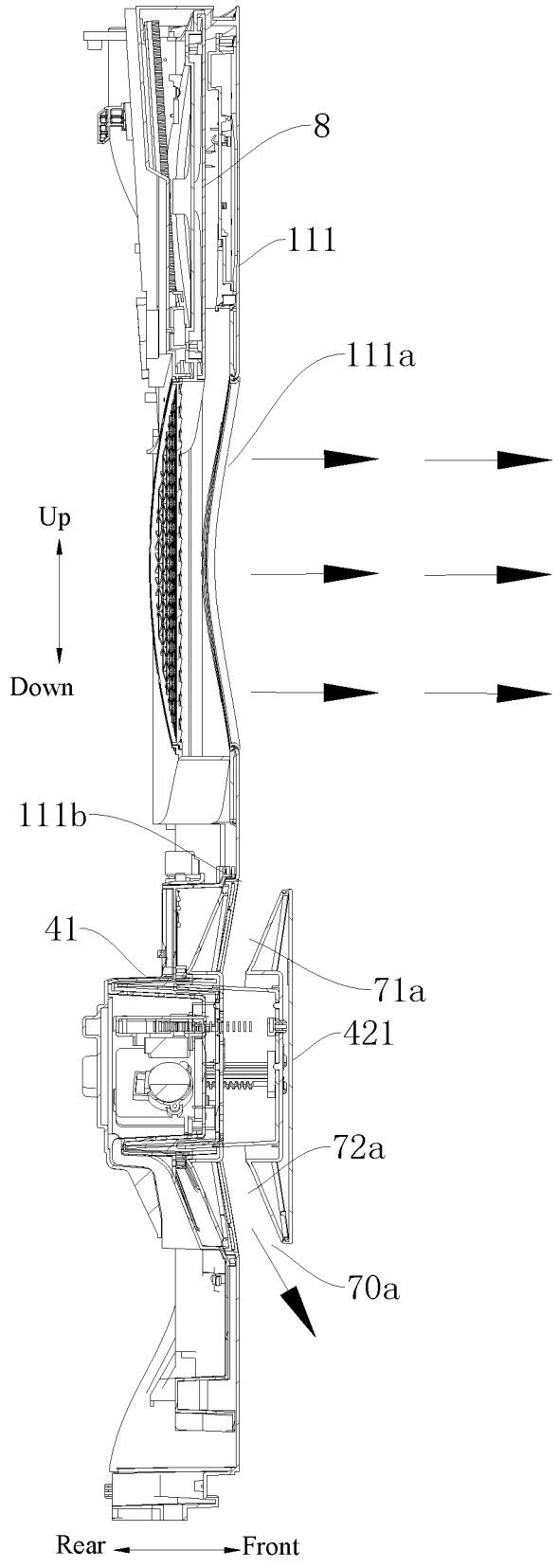
FIG. 5 is a schematic view showing air supply of the air conditioner indoor unit in FIG. 1 when in the heating mode.
Figure 6:
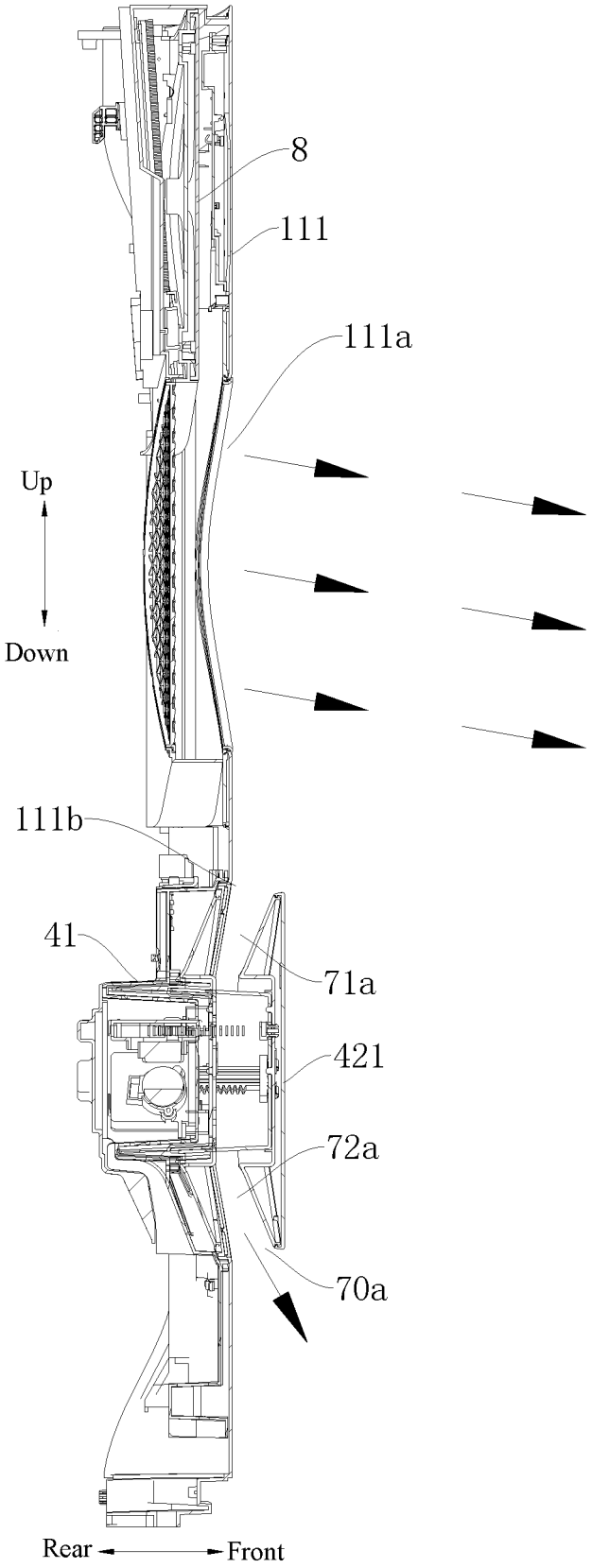
FIG. 6 is another schematic view showing air supply of the air conditioner indoor unit in FIG. 1 when in the heating mode.
Figure 7:
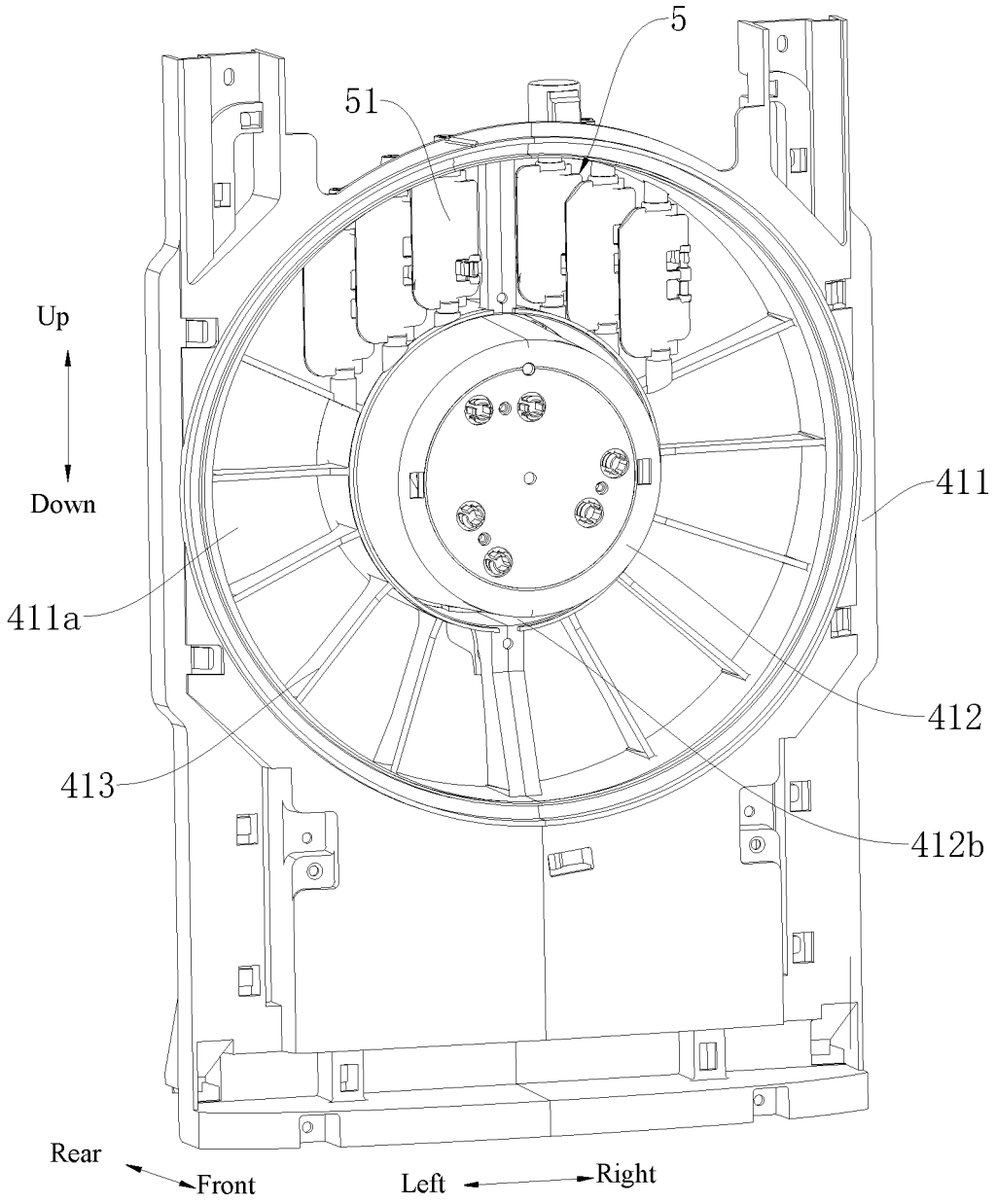
FIG. 7 is schematic view showing state of the first opening-closing mechanism when the air conditioner indoor unit as FIG. 1 is in the heating mode.
Figure 8:
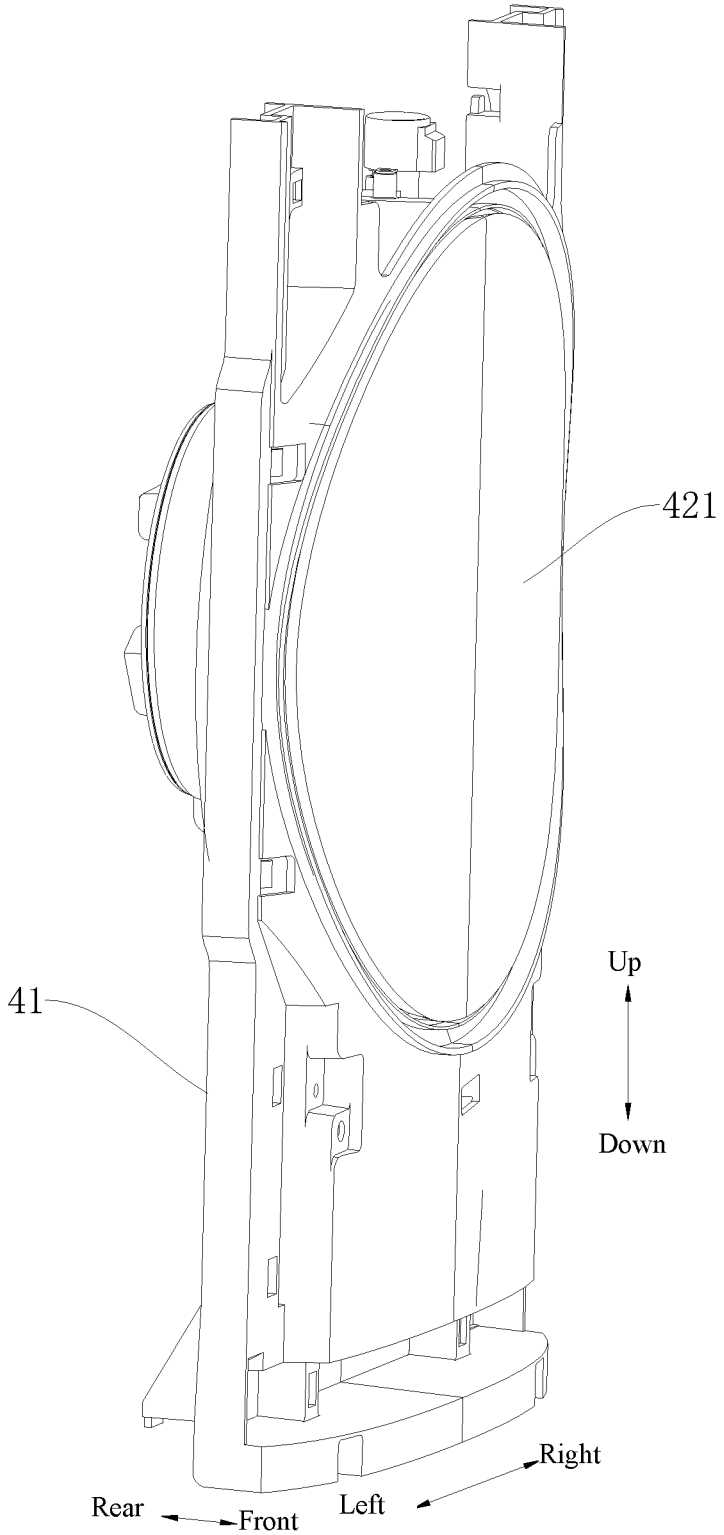
FIG. 8 is a perspective view of the air output door assembly of the air conditioner indoor unit in FIG. 1, in which the second air outlet is closed.
Figure 9:
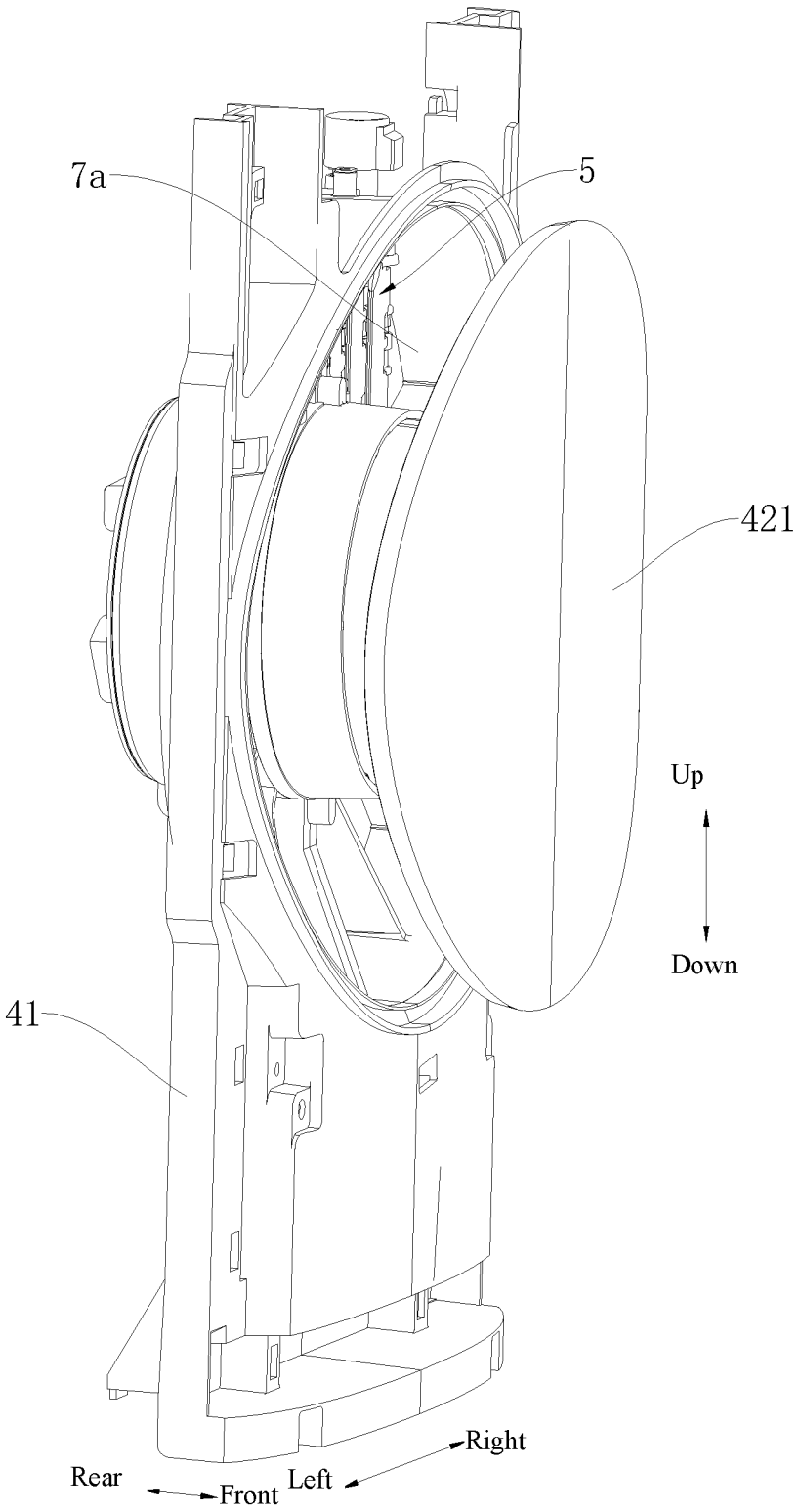
FIG. 9 is a perspective view of the air output door assembly of the air conditioner indoor unit in FIG. 1, in which the second air outlet is open.

For another example, when the air conditioner is in the heating mode (as shown in FIGS. 5-7, the direction of arrow is the flowing direction of the air), the first opening-closing mechanism 5 can be controlled to close the first air regulation channel area 711*a*, at which point the air from the second air outlet 111*b* can flow out to the room only through the part of the air output end 70*a* excluding the part corresponding to the first air regulation channel area 711*a*; for example, the air can flow out to the room through the part of the air output end 70*a* corresponding to the lower air output channel 72*a*, so that the warm air blown from the second air outlet 111*b* can be blown downwards to the floor through the part of the air output end 70*a* corresponding to the lower air output channel 72*a*, and meanwhile the effect of the air from the upper air output channel 71*a* pushing up the air from the first air outlet 111*a* can be avoided or reduced, so as to raise the air temperature at the bottom of the room, and improve the comfort level.

Optionally, the first air guiding assembly can be arranged at the first air outlet 111*a*, and can include multiple first louvers arranged at intervals in the up-down direction, where each louver is rotatable, and the rotation axis of each first louver can extend in the left-right direction. When the air conditioner is in the cooling mode, the downstream end of each first louver can be controlled to rotate upwards, so that each first louver can guide the air flow upward at an angle; when the air conditioner is in the heating mode (as shown in FIG. 7), the downstream end of each first louver can be controlled to rotate downwards so that each first louver can guide the air flow downward at an angle, which thereby improves the temperature uniformity further.

It should be noted that the "multiple" described herein refers to two or more, and the "downstream" or "upstream" described herein is defined relative to the flowing direction of the air.

For the air conditioner indoor unit 100 according to embodiments of the present disclosure, when the air conditioner is working, the air output ends 70*a* of the second air outlet 111*b* are formed to have a ring shape so that the air can be discharged all around through the second air outlet 111*b*, and the air is discharged forwards through the first air outlet 111*a*, which together realizes the stereoscopic air-out effect of the air conditioner, thereby improving the uniformity of indoor temperature; besides, the first opening-closing mechanism 5 is provided to open or close the first air regulation channel area 711*a* according to the needs, so that the first air regulation channel area 711*a* can be opened to improve the cool air volume when the air conditioner is running in the cooling mode, and the air blown from the upper air output channel 71*a* has the function of pushing the cool air up slightly; and the first air regulation channel area 711*a* can be closed to blow the warm air downwards to the floor through the part of the air output end 70*a* corresponding to the lower air output channel 72*a* when the air conditioner is running in the heating mode, so as to improve the air temperature at the bottom of the room, thus enhancing the comfort level.

According to some embodiments of the present disclosure, the area ratio between the projections of the first air regulation channel area 711*a* and the air output channel 7*a* on a same plane is valued within the scope of 1/10-1/2, where the plane is vertical to the central axis of the second air outlet 111*b*, and the central axis of the second air outlet 111*b* can extend in the front-rear direction. Therefore, setting the area ratio between the projections of the first air regulation channel area 711*a* and the air output channel 7*a* on the same plane in the above-mentioned scope not only can ensure the air volume of the second air outlet 111*b*, but also can improve the comfort level of the air.

Optionally, the area ratio between the projections of the first air regulation channel area 711*a* and the air output channel 7*a* on the same plane is 1/3, so that it can better balance and satisfy the requirements of air volume and comfort at the same time.

According to some embodiments of the present disclosure, as shown in FIG. 4 and FIG. 7, the first opening-closing mechanism 5 can be mounted in the upper air output channel 71*a* in a rotatable manner, so as to open or close the first air regulation channel area 711*a*. Therefore, the first air regulation channel area 711*a* can be opened or closed conveniently as the first opening-closing mechanism 5 rotates.

According to some optional embodiments of the present disclosure, as shown in FIG. 4 and FIG. 7, the first opening-closing mechanism 5 at least includes a first air deflector 51, that is, the first opening-closing mechanism 5 can only include a first air deflector 51, or multiple first air deflectors 51, each of which can be mounted in the first air regulation channel area 711*a* in a rotatable manner, so as to open or close the first air regulation channel area 711*a*. Thus, the structure of the first opening-closing mechanism 5 can be simplified by configuring the first opening-closing mechanism 5 to include at least one first air deflector 51. For example, when the first opening-closing mechanism 5 includes a first air deflector 51, the first air regulation channel area 711*a* can be opened or closed by rotating the first air deflector 51; when the first opening-closing mechanism 5 include multiple first air deflectors 51, the first air regulation channel area 711*a* can be opened or closed by rotating the multiple first air deflectors 51.

For example, according to some specific embodiments of the present disclosure and as shown in FIG. 4 and FIG. 7, the first opening-closing mechanism 5 includes: multiple first air deflectors 51 and the first connection rod 52. The multiple first air deflectors 51 are arranged in the circumferential direction of the air output end 70*a* of the air output channel 7*a*, each of the first air deflectors 51 is connected to the first connection rod 52 in a rotatable manner and the first connection rod 52 can move in the left-right direction, so that it can drive synchronously multiple first air deflectors 51 to rotate for the convenience of realizing the synchronous rotation of multiple first air deflectors 51 when the connection rod moves. When the first opening-closing mechanism 5 closes the first air regulation channel area 711*a*, multiple first air deflectors 51 will be lapped successively, so that when the first connection rod 52 moves, multiple first air deflectors 51 can be driven to the connection positions, so as to close the first air regulation channel area 711*a*; when the first opening-closing mechanism 5 opens the first air regulation channel area 711*a*, the air flow passage to be passed through by an air flow will be formed between two adjacent first air deflectors 51, so that the air will flow to the air output end 70*a* of the air output channel 7*a* through this air flow passage, and be blown out to the room.

According to some embodiments of the present disclosure, as shown in FIGS. 8-12, the air output door assembly 4 include: the air output bracket 41 and the air output door 42, where the air output bracket 41 is located in and connected to the housing 1, the air output door 42 is composed of the door body 421 and the connection base 422 mounted at the door body 421, and the connection base 422 is connected to the air output bracket 41 so that the door body 421 will be located in front of and separated from the second air outlet 111*b*, and the air output channel 7*a* will be formed among the air output bracket 41, the air output door 42 and the housing 1. Thus, the air output bracket 41 is configured for the convenience of installing the air output door 42, and meanwhile the air output door 42 is configured to include the above-described door body 421 and connection base 422 for the convenience of connecting the air output door 42 to the air output bracket 41, and forming the air output end 70*a* of the above-described air output channel 7*a* between the boundary of the door body 421 and the housing 1. Optionally, both the second air outlet 111*b* and the door body 421 can be circular.

Figure 10:
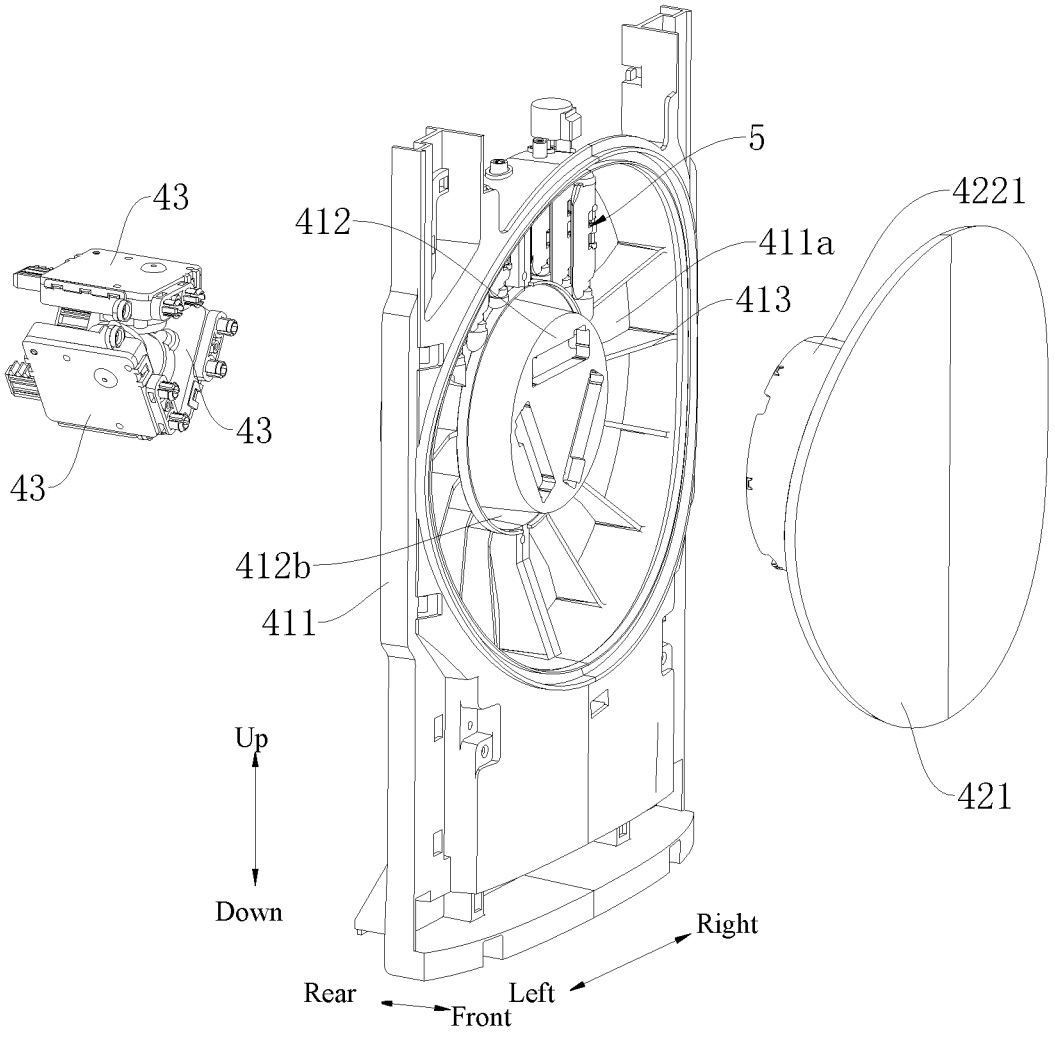
FIG. 10 is an exploded view of the air output door assembly of the air conditioner indoor unit in FIG. 1.

According to some optional embodiments of the present disclosure, as shown in FIG. 4, FIG. 7 and FIG. 10, the first opening-closing mechanism 5 can be mounted at the air output bracket 41 in a movable manner, so as to open or close the first air regulation channel area 711*a*. It is thus convenient to install the first opening-closing mechanism 5; for example, the first opening-closing mechanism 5 can be mounted at the air output bracket 41 which can be installed in the housing 1.

Further, as shown in FIG. 4, FIG. 7 and FIG. 10, the annular channel 411*a* is formed at the air output bracket 41, and constitutes a part of the air output channel 7*a*. The annular channel 411*a* (for example, the annular channel 411*a* can be annular) and the second air outlet 111*b* (for example, the second air outlet 111*b* can be round) can be co-axial, that is, the central axis of the annular channel 411*a* coincides with the central axis of the second air outlet 111*b*; the part of the annular channel 411*a* located above the above-described reference plane constitutes a part of the upper air output channel 71*a*, while the part of the annular channel 411*a* located below the above-described reference plane constitutes a part of the lower air output channel 72*a*. The first opening-closing mechanism 5 can be mounted in the annular channel 411*a* in a rotatable manner, so as to open or close the first air regulation channel area 711*a*, which thus makes the installation of the first opening-closing mechanism 5 convenient. Meanwhile, the first opening-closing mechanism 5 can rotate, so that the first air regulation channel area 711*a* can be opened or closed conveniently.

In the examples of FIG. 4 and FIG. 7, the annular channel 411*a* is formed at the air output bracket 41, and constitutes a part of the air output channel 7*a*. The annular channel 411*a* which is annular and the second air outlet 111*b* which is round can be set co-axial; the part of the annular channel 411*a* located above the above-described reference plane constitutes a part of the upper air output channel 71*a*, while the part of the annular channel 411*a* located below the above-described reference plane constitutes a part of the lower air output channel 72*a*. The first opening-closing mechanism 5 can be mounted in the part of the annular channel 411*a* above the reference plane in a rotatable manner, so as to open or close the first air regulation channel area 711*a*.

In this case, the first opening-closing mechanism 5 includes multiple first air deflectors 51 and the first connection rod 52; each of the first air deflectors 51 is connected to the inner wall of the annular channel 411*a* in a rotatable manner, the rotation axis of each first air deflector 51 can extend in the up-down direction, the first connection rod 52 extends approximately in the left-right direction and each of the first air deflectors 51 is connected to the first connection rod 52 in a rotatable manner, so that it can drive multiple first air deflectors 51 to rotate synchronously by moving the first connection rod 52. When multiple first air deflectors 51 are lapped successively, the multiple first air deflectors 51 will close the first air regulation channel area 711*a*; the air flow passage to be passed through by an air flow is formed between two adjacent first air deflectors 51, and when the first air regulation channel area 711*a* is opened, so that the air can flow to the air output end 70*a* of the air output channel 7*a* through this air flow passage, and then be blown out to the room.

According to some optional embodiments of the present disclosure, as shown in FIGS. 8-12, the air output door 42 can move in the front-rear direction between the open position and the closed position; when the air output door 42 is on the open position, the door body 421 will be located in front of and separated from the second air outlet 111*b*, so as to open the second air outlet 111*b*; when the air output door 42 is on the closed position, the door body 421 will work with the second air outlet 111*b* to close the latter. Therefore, the second air outlet 111*b* can be opened or closed conveniently by moving the air output door 42 forwards or backwards; when the air conditioner is working, the air output door 42 moves forwards to the open position, so as to open the second air outlet 111*b*; when the air conditioner is not working, the air output door 42 moves backwards to the closed position, so as to open the second air outlet 111*b* for preventing the dust and other sundries from entering the housing 1.

Figure 11:
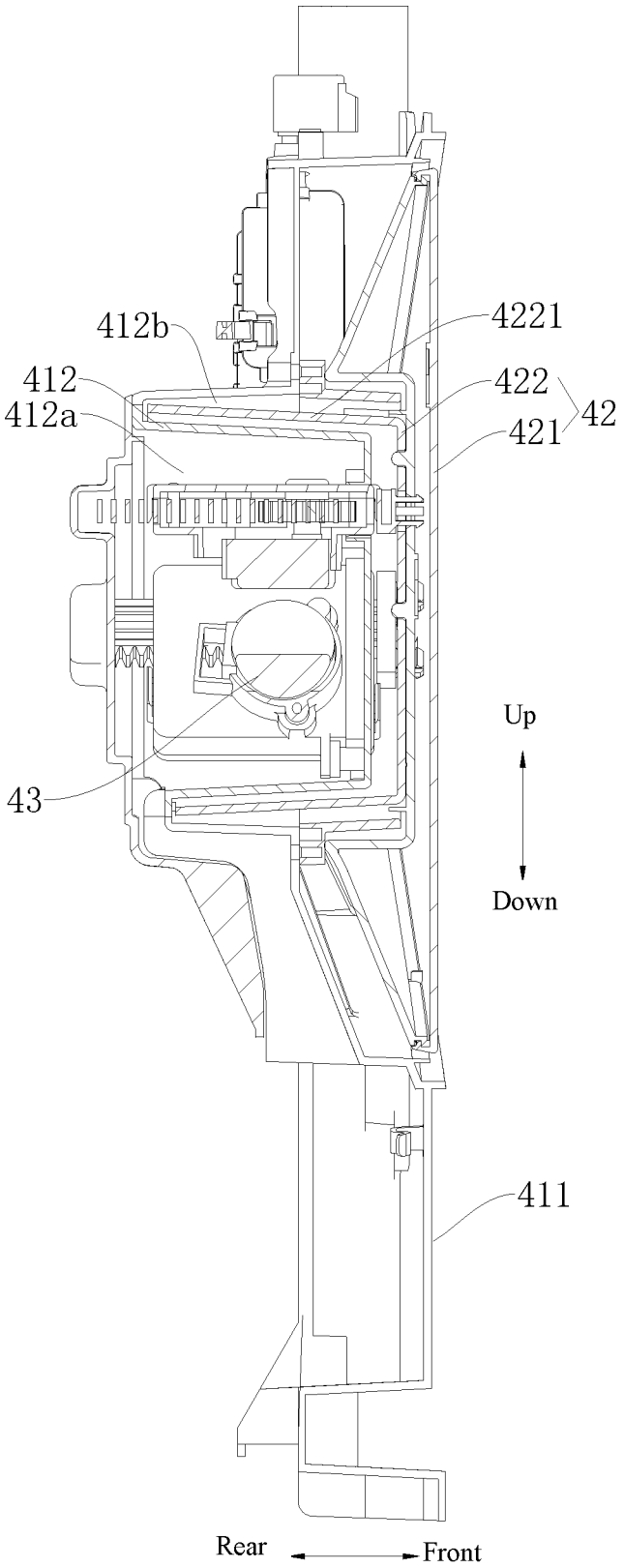
FIG. 11 is a longitudinal cross-sectional view of the air output door assembly of the air conditioner indoor unit in FIG. 1, in which the second air outlet is closed.
Figure 12:
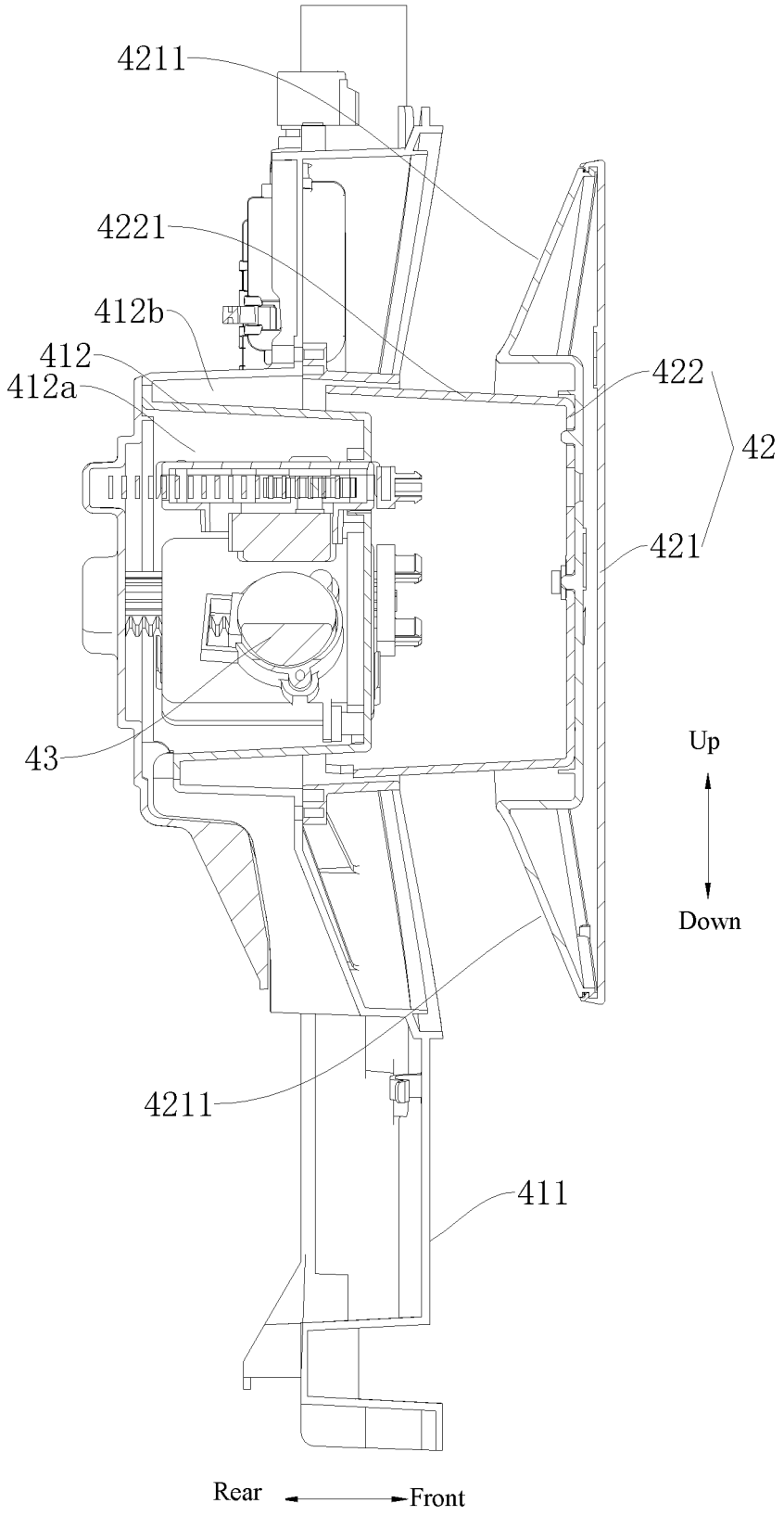
FIG. 12 is a longitudinal cross-sectional view of the air output door assembly of the air conditioner indoor unit in FIG. 1, in which the second air outlet is open.

Optionally, as shown in FIGS. 10-12, one the air output bracket 41 and the connection base 422 is configured with the guiding groove 412*b*, while another is formed with the guiding part 4221 matching the guiding groove 412*b*, where the guiding part 4221 matches in the guiding groove 412*b*, and can move in the front-rear direction relative to the guiding groove 412*b*. Thus, when the air output door 42 moves, the guiding groove 412*b* will match with the guiding part 4221 so that the guiding part 4221 will move in front-rear direction relative to the guiding groove 412*b*, so as to guide the movement of the air output door 42 and make the air output door 42 move steadily in the set direction.

Optionally, as shown in FIGS. 10-12, both the guiding groove 412*b* and the guiding part 4221 are formed to have a ring shape, so that the contact area between the guiding groove 412*b* and the guiding part 4221 will become larger, and meanwhile the guiding part 4221 and the guiding groove 412*b* can limit each other in the plane vertical to the front-rear direction, so as to improve the moving stability of the air output door 42 further.

According to some optional embodiments of the present disclosure, as shown in FIGS. 10-12, the air output door assembly 4 includes: the driving mechanism 43 used to drive the air output door 42 to move in the front-rear direction, where the driving mechanism 43 is mounted at the air output bracket 41 and is connected to the connection base 422. Therefore, the driving mechanism 43 is configured for the convenience of moving the air output door 42, and is mounted at the air output bracket 41 for the convenience of installing the driving mechanism 43; for example, the driving mechanism 43 can be installed on the air output bracket 41, and the air output bracket 41 can be installed in the housing 1, which is also conducive to the modularization of all parts of the whole machine.

Optionally, as shown in FIG. 10, there are multiple driving mechanisms 43 which are arranged in the circumferential direction of the connection base 422, so that the air output door 42 can be driven more stably to move steadily and evenly.

According to embodiments of FIGS. 10-12, the air output bracket 41 includes the bracket body 411 and the mounting part 412 connected to the bracket body 411, where the through-hole is formed at the bracket body 411, the mounting part 412 is located in the through-hole and is separated from the inner wall of the through-hole, the above-described annular channel 411*a* is formed between the outer wall of the mounting part 412 and the inner wall of the through-hole, the outer wall of the mounting part 412 is connected to the inner wall of the through-hole with multiple connection ribs 413 which are arranged at interval in the circumferential direction of the annular channel 411*a*.

The middle of the mounting part 412 is protrudes forwards to form the mounting cavity 412*a* behind the mounting part 412, the mounting cavity 412*a* is separated from the outer wall of the mounting part 412; there are three driving mechanisms 43 which constitute a triangle, and are accommodated in the mounting cavity 412*a*; the connecting ends of the three driving mechanisms 43 penetrate through the mounting part 412 respectively and connected to the connection base 422. The annular guiding groove 412*b* is formed between the surrounding wall of the mounting cavity 412*a* and the outer wall of the mounting part 412, the guiding part 4221 matching the guiding groove 412*b* is located on the connection base 422, is cylindrical and is inserted into the guiding groove 412*b*; when the air output door 42 is moving, the guiding part 4221 will slide forwards or backwards along the guiding groove 412*b*, so that the air output door 42 could move stably.

In other embodiments of the present disclosure, the connection between the air output door 42 and the air output bracket 41 can be fixed, that is, the air output door 42 is fixed relative to the air output bracket 41, so that the air output door 42 is always on the position of opening the second air outlet 111*b*.

According to some optional embodiments of the present disclosure, as shown in FIGS. 3, 5, 6 and 12, the wall surface of the door body 421 facing the second air outlet 111*b* constitutes a part of the inner wall surface of the air output channel 7*a*, at least a part of wall surface of the door body 421 facing the second air outlet 111*b* constitutes the flow guiding surface 4211, and the flow guiding surface 4211 extends forwards in an angle from the center of the door body 421 to the periphery of the door body 421. Thus, the flow guiding surface 4211 mounted at the door body 421 is provided to guide the air flow toward the periphery of the second air outlet 111*b*, and forward, which thereby improves the air-out effect of the second air outlet 111*b* further.

According to some embodiments of the present disclosure, as shown in FIGS. 2, 3, 5 and 6, the air conditioner indoor unit 100 includes: the door 8 which is mounted in the housing 1 movable in up-down direction, so as to open or close the first air outlet 111*a*. Thus, the first air outlet 111*a* can be opened or closed conveniently by moving the door 8; when the air conditioner is working, the door 8 can move upwards to open the first air outlet 111*a*; when the air conditioner is not working, the door 8 can move downwards to close the first air outlet 111*a*, so as to prevent the external dust etc. from entering the housing 1.

Figure 13:
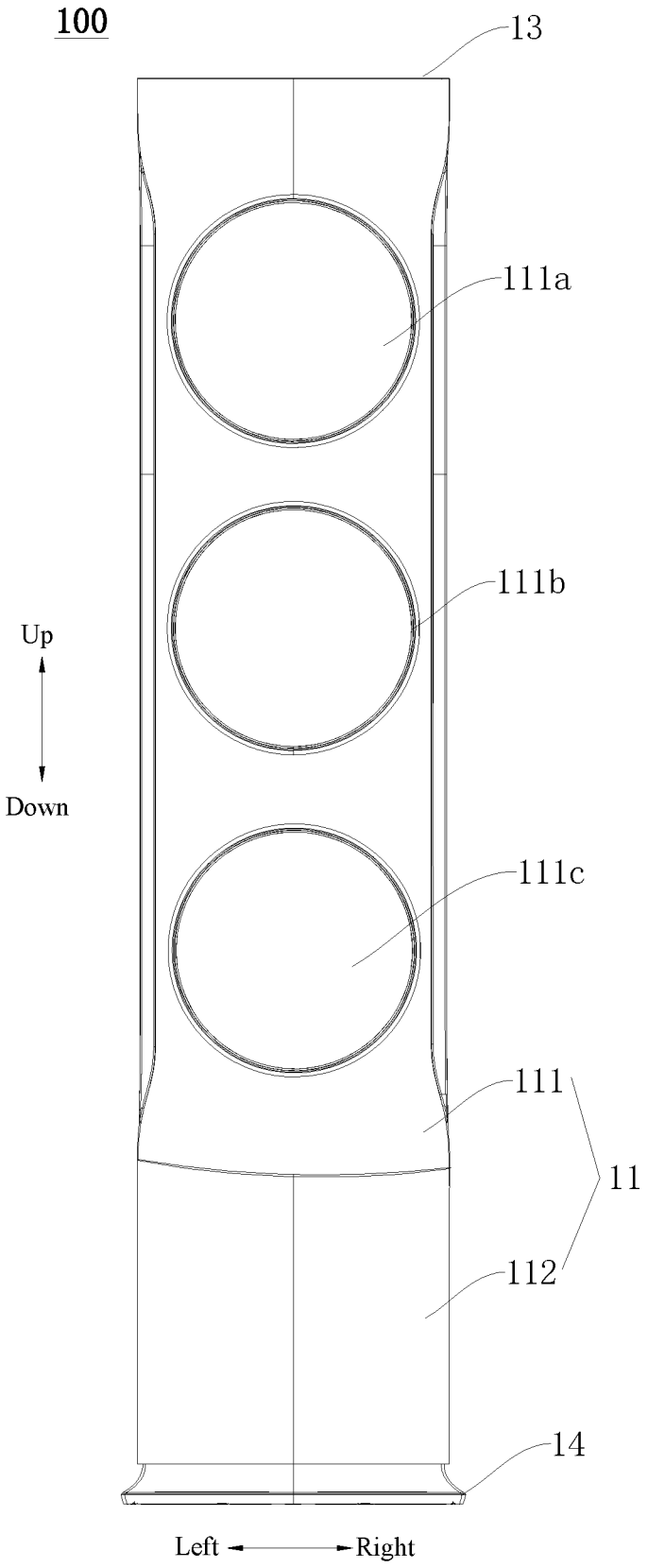
FIG. 13 is a schematic view of an air conditioner indoor unit according to another embodiment of the present disclosure.
Figure 14:
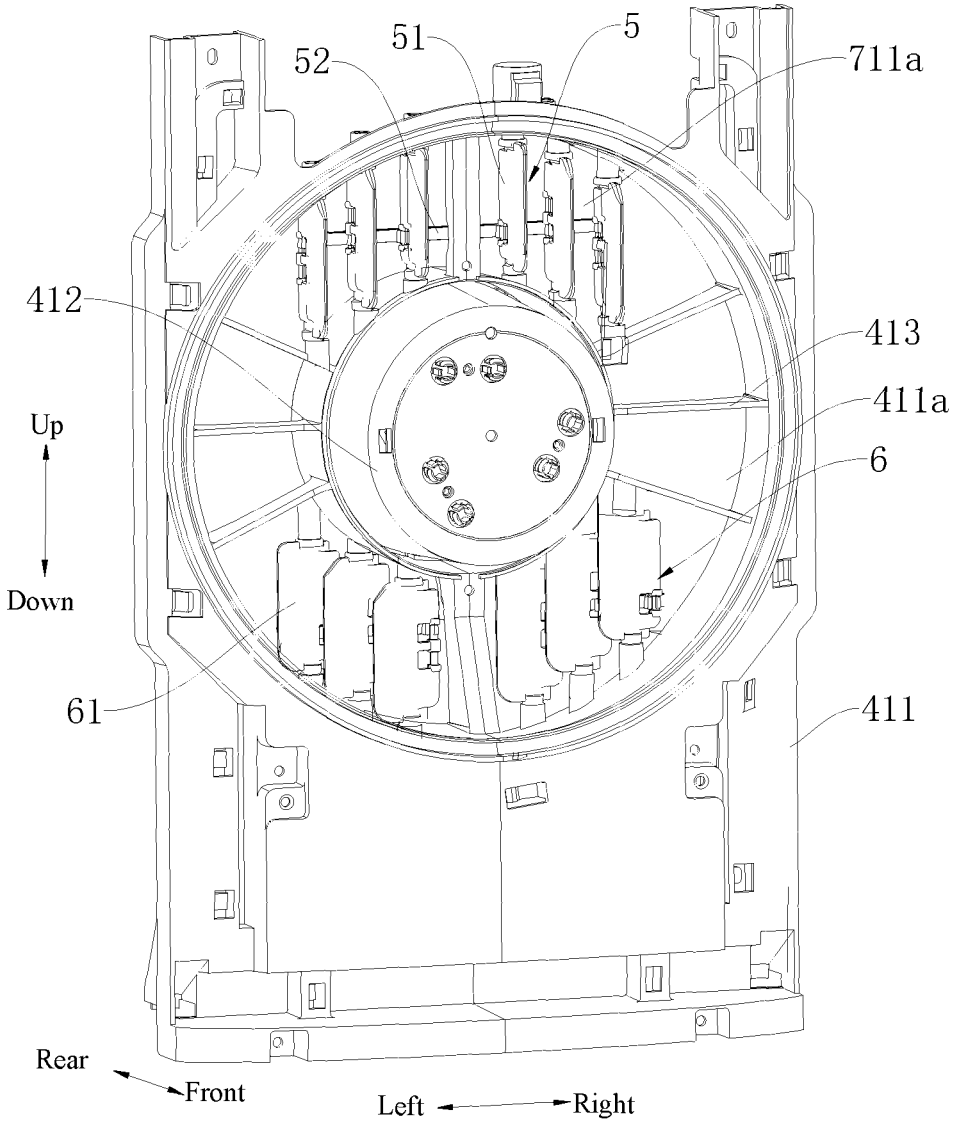
FIG. 14 is a schematic view showing states of the first opening-closing mechanism and the second opening-closing mechanism when the air conditioner indoor unit in FIG. 13 is in the cooling mode.
Figure 15:
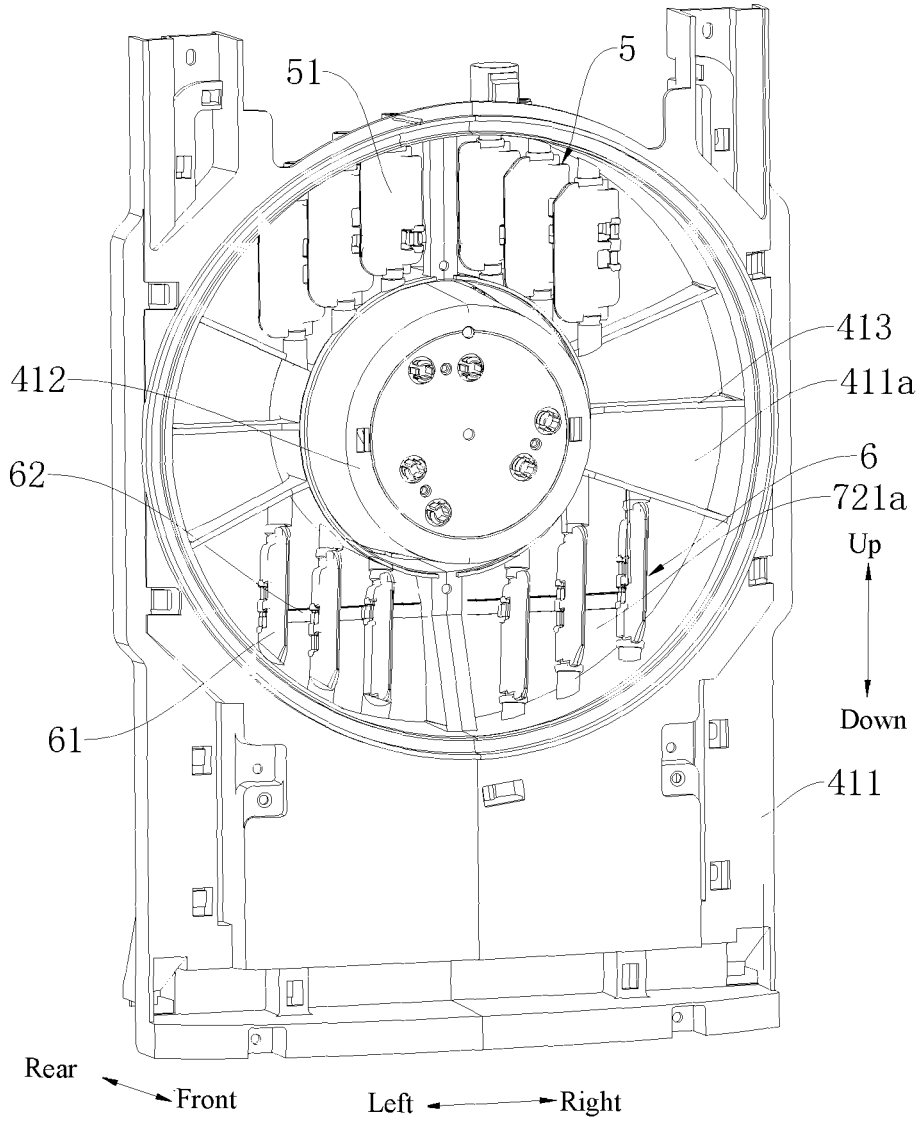
FIG. 15 is a schematic view showing states of the first opening-closing mechanism and the second opening-closing mechanism when the air conditioner indoor unit in FIG. 13 is in the heating mode.

In the further embodiments of the present disclosure, as shown in FIGS. 13-15, the third air outlet 111*c* is also formed at the housing 1, and is located below the second air outlet 111*b*, at least a part of the lower air output channel 72*a* constitutes the second air regulation channel area 721*a*, that is, the second air regulation channel area 721*a* can be only a part of the lower air output channel 72*a*, or the entire lower air output channel 72*a*. The air output door assembly 4 also includes: the second opening-closing mechanism 6 used to open or close the second air regulation channel area 721*a*, which can be mounted at the air output door assembly 4 in a movable manner.

The second air regulation channel area 721*a* can be opened or closed by moving the second opening-closing mechanism 6. When the second air regulation channel area 721*a* is closed, the air from the second air outlet 111*b* can flow out to the room only through the part of the air output end 70*a* excluding the part corresponding to the second air regulation channel area 721*a*, for example through the part of the air output end 70*a* corresponding to the upper air output channel 71*a*. When the second air regulation channel area 721*a* is open, the air from the second air outlet 111*b* may flow out to the room through the entire air output end 70*a* corresponding to the entire air output channel 7*a*, at which point the air volume can be increased; alternatively, when the second air regulation channel area 721*a* is open, the air from the second air outlet 111*b* can flow out to the room only through the part of the air output end 70*a* excluding the part corresponding to the first air regulation channel area 711*a*, for example through the part of the air output end 70*a* corresponding to the lower air output channel 72*a*.

Optionally, the second opening-closing mechanism 6 can be mounted at the air output door assembly 4 in a movable manner, at which point the second opening-closing mechanism 6 can be moved to open or close the second air regulation channel area 721*a*; the second opening-closing mechanism 6 can also be mounted at the air output door assembly 4 in a rotatable manner, at which point the second opening-closing mechanism 6 can be rotated to open or close the second air regulation channel area 721*a*.

For this purpose, when the air conditioner is working, the first opening-closing mechanism 5 can be controlled according to the working pattern of the air conditioner to open or close the first air regulation channel area 711*a*; moreover, the second opening-closing mechanism 6 can be controlled to open or close the second air regulation channel area 721*a*.

For example, when the air conditioner is in the cooling mode (as shown in FIG. 14), the first opening-closing mechanism 5 can be controlled to open the first air regulation channel area 711*a*, and the second opening-closing mechanism 6 can be controlled to close the second air regulation channel area 721*a*, at which point the air from the second air outlet 111*b* can flow out to the room through the part of the air output end 70*a* excluding the part corresponding to the second air regulation channel area 721*a*, relatively high cool air volume is available, the air blown from the upper air output channel 71*a* has the function of pushing the cool air up slightly and the cool air blown from the upper air output channel 71*a* has the function of pushing up the air from the first air outlet 111*a* slightly, improving the temperature uniformity in the cooling mode. Moreover, it makes the cool air from the second air outlet 111*b* to be blown upwards in an angle through the upper air output channel 71*a*, and meanwhile the effect of air from the lower air output channel 72*a* pushing down the air from the third air outlet 111*c* can be avoided or reduced to improve the temperature uniformity better in the cooling mode.

For another example, when the air conditioner is in the heating mode (as shown in FIG. 15), the first opening-closing mechanism 5 can be controlled to close the first air regulation channel area 711*a*, and the second opening-closing mechanism 6 can be controlled to open the second air regulation channel area 721*a*, at which point the air from the second air outlet 111*b* can flow out to the room only through the part of the air output end 70*a* excluding the part corresponding to the first air regulation channel area 711*a*, which thus can increase the warm air volume, while the air from the lower air output channel 72*a* has the function of pushing the warm air down slightly, and the warm air from the lower air output channel 72*a* has the function of pushing down the air from the third air outlet 111*c* slightly, which improves the temperature uniformity in the heating mode. Moreover, the warm air blown from the second air outlet 111*b* can be blown downwards to the floor through the part of the air output end 70*a* corresponding to the lower air output channel 72*a*, and meanwhile the effect of the air from the upper air output channel 71*a* pushing up the air from the first air outlet 111*a* can be avoided or reduced, so as to raise the air temperature at the bottom of the room, and improve the comfort level.

Optionally, the second air guiding assembly can be arranged at the third air outlet 111*c*, and can include multiple second louvers arranged at intervals in the up-down direction, where each second louver is rotatable, and the rotation axis of each second louver can extend in the left-right direction. When the air conditioner is in the cooling mode, the downstream end of each second louver can be controlled to rotate upwards, so that each second louver can guide the air flow upward at an angle; when the air conditioner is in the heating mode, the downstream end of each second louver can be controlled to rotate downwards so that each second louver can guide the air flow downward at an angle, which thereby improves the temperature uniformity further.

Optionally, as shown in FIGS. 14 and 15, the second opening-closing mechanism 6 can be mounted in the lower air output channel 72*a* in a rotatable manner, for example in the second air regulation channel area 721*a*, so as to open or close the latter. Therefore, the second air regulation channel area 721*a* can be opened or closed conveniently by rotating the second opening-closing mechanism 6.

In the examples of FIG. 14 and FIG. 15, the air output door assembly 4 includes the above-described the air output bracket 41 and the air output door 42, where the annular channel 411*a* is formed at the air output bracket 41, and constitutes a part of the air output channel 7*a*; the annular channel 411*a* which is annular and the second air outlet 111*b* which is round can be set co-axial; the part of the annular channel 411*a* located above the above-described reference plane constitutes a part of the upper air output channel 71*a*, while the part of the annular channel 411*a* located below the above-described reference plane constitutes a part of the lower air output channel 72*a*. Both the first opening-closing mechanism 5 and the second opening-closing mechanism 6 can be mounted in the annular channel 411*a* in a rotatable manner, the first opening-closing mechanism 5 is mounted in the part of the annular channel 411*a* above the above-described reference plane, so as to open or close the first air regulation channel area 711*a*; the second opening-closing mechanism 6 is mounted in the part of the annular channel 411*a* below the above-described reference plane, so as to open or close the second air regulation channel area 721*a*.

In this case, the first opening-closing mechanism 5 includes multiple first air deflectors 51 and the first connection rod 52; the multiple first air deflectors 51 are arranged in the circumferential direction of the annular channel 411*a*; each of the first air deflectors 51 is connected to the inner wall of the annular channel 411*a* in a rotatable manner, the rotation axis of each first air deflector 51 can extend in the up-down direction, the first connection rod 52 extends approximately in the left-right direction and each of the first air deflectors 51 is connected to the first connection rod 52 in a rotatable manner, so that it can drive multiple first air deflectors 51 to rotate synchronously by moving the first connection rod 52. When multiple first air deflectors 51 are lapped successively, the multiple first air deflectors 51 will close the first air regulation channel area 711*a*; the air flow passage to be passed through by an air flow is formed between two adjacent first air deflectors 51, and when the first air regulation channel area 711*a* is opened, so that the air can flow to the air output end 70*a* of the air output channel 7*a* through this air flow passage, and then be blown out to the room.

Also as shown in FIG. 14 and FIG. 15, the second opening-closing mechanism 6 includes multiple second air deflector 61 and the second connection rod 62; the multiple second air deflectors 61 are arranged in the circumferential direction of the annular channel 411*a*; each of the second air deflectors 61 is connected to the inner wall of the annular channel 411*a* in a rotatable manner, the rotation axis of each second air deflector 61 can extend in the up-down direction, the second connection rod 62 extends approximately in the left-right direction and each of the second air deflectors 61 is connected to the second connection rod 62 in a rotatable manner, so that it can drive multiple second air deflectors 61 to rotate synchronously by moving the second connection rod 62. When multiple second air deflectors 61 are lapped successively, the multiple second air deflectors 61 will close the second air regulation channel area 721*a*; the air flow passage to be passed through by an air flow is formed between two adjacent second air deflectors 61, and when the second air regulation channel area 721*a* is opened, so that the air can flow to the air output end 70*a* of the air output channel 7*a* through this air flow passage, and then be blown out to the room.

According to the embodiment of the second aspect of the present disclosure, the air conditioner includes: the air conditioner indoor unit 100 and the air conditioner outdoor unit, where the air conditioner indoor unit 100 is the air conditioner indoor unit 100 according to embodiments of the first aspect of the present disclosure, and is connected to the air conditioner outdoor unit to constitute a refrigerant cycle.

According to the embodiment of the present disclosure, the air conditioner indoor unit 100 is configured as above to realize the stereoscopic air-out effect of the air conditioner, improve the indoor temperature uniformity and raise the air temperature at the bottom of the room, enhancing the comfort level when the air conditioner is running in the heating mode.

As shown in FIGS. 2-6, according to the control method for the air conditioner according to embodiments of the third aspect of the present disclosure, the air conditioner is the air conditioner according to embodiments of the second aspect of the present disclosure, which has a cooling mode and a heating mode. The control method includes the following steps:

Judge the current operation mode of air conditioner;

Control the first opening-closing mechanism 5 according to the current operation mode of the air conditioner: when the air conditioner is in the cooling mode (as shown in FIG. 3 and FIG. 4, the direction of arrow is the flowing direction of the air), the first opening-closing mechanism 5 can be controlled to open the first air regulation channel area 711*a*; at this moment, the air from the second air outlet 111*b* can flow out to the room through the entire air output end 70*a* corresponding to the entire air output channel 7*a*, which can increase the cool air volume. Besides, the air blown from the upper air output channel 71*a* has the function of pushing the cool air up slightly, and the cool air blown from the upper air output channel 71*a* has the function of pushing the air from the first air outlet 111*a* up slightly, which improves the temperature uniformity further in the cooling mode; when the air conditioner is in the heating mode (as shown in FIGS. 5-7, the direction of arrow is the flowing direction of the air), the first opening-closing mechanism 5 can be controlled to close the first air regulation channel area 711*a*, at which point the air from the second air outlet 111*b* can flow out to the room only through the part of air output end 70*a* excluding the part corresponding to the first air regulation channel area 711*a*; for example, the air can flow out to the room through the part of the air output end 70*a* corresponding to the lower air output channel 72*a*, so that the warm air blown from the second air outlet 111*b* can be blown downwards to the floor through the part of the air output end 70*a* corresponding to the lower air output channel 72*a*, and meanwhile the effect of the air from the upper air output channel 71*a* pushing up the air from the first air outlet 111*a* can be avoided or reduced, so as to raise the air temperature at the bottom of the room, and improve the comfort level.

According to the control method for the air conditioner according to embodiments of the present disclosure, relatively high cool air volume is available when the air conditioner is running in the cooling mode; the air temperature at the bottom of the room can be raised and the comfort level can be improved when the air conditioner is running in the heating mode.

According to some embodiments of the present disclosure, as shown in FIGS. 13-15, the third air outlet 111*c* is formed at the housing 1, and is located below the second air outlet 111*b*, at least a part of the lower air output channel 72*a* constitutes the second air regulation channel area 721*a*, that is, the second air regulation channel area 721*a* can be only a part of the lower air output channel 72*a*, or the entire lower air output channel 72*a*. The air output door assembly 4 also includes the second opening-closing mechanism 6 used to open or close the second air regulation channel area 721*a*, which can be mounted at the air output door assembly 4 in a movable manner.

When the air conditioner is in the cooling mode (as shown in FIG. 14), the first opening-closing mechanism 5 opens the first air regulation channel area 711*a* and the second opening-closing mechanism 6 closes the second air regulation channel area 721*a*, at which point the air from the second air outlet 111*b* can flow out to the room through the part of the air output end 70*a* excluding the part corresponding to the second air regulation channel area 721*a*, relatively high cool air volume is available, the air blown from the upper air output channel 71*a* has the function of pushing the cool air up slightly and the cool air blown from the upper air output channel 71*a* has the function of pushing up the air from the first air outlet 111*a* slightly, improving the temperature uniformity in the cooling mode. Moreover, it makes the cool air from the second air outlet 111*b* to be blown upwards in an angle through the upper air output channel 71*a*, and meanwhile the effect of air from the lower air output channel 72*a* pushing down the air from the third air outlet 111*c* can be avoided or reduced to improve the temperature uniformity better in the cooling mode.

When the air conditioner is in the heating mode (as shown in FIG. 15), the first opening-closing mechanism 5 closes the first air regulation channel area 711*a*, while the second opening-closing mechanism 6 opens the second air regulation channel area 721*a*, at which point the air from the second air outlet 111*b* can flow out to the room only through the part of air output end 70*a* excluding the part corresponding to the first air regulation channel area 711*a* and relatively high warm air volume is available; the air from the lower air output channel 72*a* has the function of pushing the warm air down slightly, while the warm air from the lower air output channel 72*a* has the function of pushing down the air from the third air outlet 111*c* slightly, which enhances the temperature uniformity further in the heating mode. In addition, the warm air blown from the second air outlet 111*b* can be blown downwards to the floor through the part of the air output end 70*a* corresponding to the lower air output channel 72*a*, and meanwhile the effect of the air from the upper air output channel 71*a* pushing up the air from the first air outlet 111*a* can be avoided or reduced, so as to raise the air temperature at the bottom of the room, and improve the comfort level.

In the description of the present disclosure, the terms "an embodiment", "some embodiments" and "schematic embodiment", "example", "specific example", or "some examples" etc. mean that the specific feature, structure, material or characteristic of that embodiment or example described are included in at least one embodiment or example of the present disclosure. In this description, the schematic presentation of such terms may not refer to the same embodiment or example. Moreover, the specific features, structure, material or characteristics described may be combined in an appropriate manner in any one or multiple embodiments or examples. Although the embodiments of the present disclosure have been presented and described, the ordinary technical personnel in the field can understand that multiple changes, modifications, substitutions and variations of such embodiments can be made without deviating from the principles and purposes of the present disclosure, and that the scope of the invention is defined by the claims and their equivalents.

The invention claimed is:

1. An air conditioner indoor unit, comprising: a housing having an air inlet, a first air outlet, and a second air outlet arranged below the first air outlet; a first door arranged corresponding to the first air outlet and configured to move in a direction parallel to a surface of the first door to open or close the first air outlet; an air output door assembly arranged at the second air outlet and connected to the housing, at least a portion of the air output door assembly being configured to move relative to the housing to form an air output channel between the at least a portion of the air output door assembly and the housing, and the air output channel having a ring-shaped air output end located in front of the second air outlet, the at least a portion of the air output door assembly including a second door configured to move relative to the second air outlet to open and close the second air outlet; an opening-closing mechanism movably mounted at the air output door assembly and configured to open or close an air regulation channel area that includes an upper part of the air output channel; and a heat exchanger assembly and an air duct assembly both arranged in the housing; wherein a movement direction of the first door relative to the first air outlet is perpendicular to a movement direction of the second door relative to the second air outlet, wherein an area ratio of a projection of the air regulation channel area on a plane perpendicular to a central axis of the second air outlet to a projection of the air output channel on the plane is in a range of 1/10-1/2.

2. The air conditioner indoor unit according to claim 1, wherein the opening-closing mechanism is rotatably arranged in the upper part of the air output channel.

3. The air conditioner indoor unit according to claim 2, wherein the opening-closing mechanism comprises at least one air deflector rotatably mounted in the air regulation channel area, and configured to open or close at least a portion of the air regulation channel area.

4. The air conditioner indoor unit according to claim 2, wherein the opening-closing mechanism comprises:

a connection rod; and a plurality of air deflectors arranged in a circumferential direction of the air output end of the air output channel and rotatably connected to the connection rod, the plurality of air deflectors being configured to lap one on another successively when the connection rod moves in a first direction, and to open to form at least one air flow passage for air flow to pass when the connection rod moves in a second direction opposite to the first direction.

5. The air conditioner indoor unit according to claim 1, wherein:

the air output door assembly comprises:

an air output bracket arranged in and connected to the housing; and the second door comprising a door body and a connection base arranged at the door body, the connection base being connected to the air output bracket, and the door body being located in front of and separated from the second air outlet; and the air output channel is formed by the air output bracket, the second door, and the housing.

6. The air conditioner indoor unit according to claim 5, wherein the opening-closing mechanism is movably mounted at the air output bracket.

7. The air conditioner indoor unit according to claim 6, wherein:

the air output channel includes an annular channel formed in the air output bracket; and the opening-closing mechanism is rotatably arranged in the annular channel.

8. The air conditioner indoor unit according to claim 5, wherein the second door is movable between:

an open position at which the second door is located in front of and separated from the second air outlet to open the second air outlet, and a closed position at which the door body is fitted with the second air outlet to close the second air outlet.

9. The air conditioner indoor unit according to claim 8, wherein:

one of the air output bracket and the connection base includes a guiding groove, and another one of the air output bracket and the connection base includes a guiding part fitted with the guiding groove; and the guiding part and the guiding groove are movable relative to each other.

10. The air conditioner indoor unit according to claim 9, wherein each of the guiding groove and the guiding part has a ring shape.

11. The air conditioner indoor unit according to claim 8, wherein the air output door assembly comprises a driving mechanism arranged at the air output bracket and connected to the connection base, the driving mechanism being configured to drive the second door to move between the open position and the closed position.

12. The air conditioner indoor unit according to claim 11, wherein the driving mechanism is one of a plurality of driving mechanisms of the air output door assembly that are arranged in a circumferential direction of the connection base.

13. The air conditioner indoor unit according to claim 5, wherein a wall surface of the door body facing the second air outlet forms a part of an inner wall surface of the air output channel, and at least a part of the wall surface of the door body facing the second air outlet extends forwards obliquely in a direction from a center of the door body to a periphery of the door body.

14. The air conditioner indoor unit according to claim 1, wherein:

the opening-closing mechanism is a first opening-closing mechanism and the air regulation channel area is a first air regulation channel area;

the housing further includes a third air outlet located below the second air outlet; and the air output door assembly further comprises a second opening-closing mechanism movably arranged at the air output door assembly and configured to open or close a second air regulation channel area that includes a lower part of the air output channel.

15. The air conditioner indoor unit according to claim 14, wherein the second opening-closing mechanism is rotatably arranged in the lower part of the air output channel.

16. The air conditioner indoor unit according to claim 1, wherein:

the air opening-closing mechanism is located at an upper portion of the second air outlet that is closer than a lower portion of the second air outlet to the first air outlet, wherein the upper portion and the lower portion are at two sides of a horizontal plane passing through a center of the second air outlet; and the opening-closing mechanism is configured to be open in a cooling mode and to be closed in a heating mode, to improve temperature uniformity.

17. An air conditioner, comprising: an air conditioner indoor unit including: a housing having an air inlet, a first air outlet, and a second air outlet arranged below the first air outlet; a first door arranged corresponding to the first air outlet and configured to move in a direction parallel to a surface of the first door to open or close the first air outlet; an air output door assembly arranged at the second air outlet and connected to the housing, at least a portion of the air output door assembly being configured to move relative to the housing to form an air output channel between the at least a portion of the air output door assembly and the housing, the air output channel having a ring-shaped air output end located in front of the second air outlet, the at least a portion of the air output door assembly including a second door configured to move relative to the second air outlet to open and close the second air outlet; an opening-closing mechanism movably mounted at the air output door assembly and configured to open or close an air regulation channel area that includes an upper part of the air output channel; and a heat exchanger assembly and an air duct assembly both arranged in the housing; and an air conditioner outdoor unit connected to the air conditioner indoor unit; wherein a movement direction of the first door relative to the first air outlet is perpendicular to a movement direction of the second door relative to the second air outlet, wherein an area ratio of a projection of the air regulation channel area on a plane perpendicular to a central axis of the second air outlet to a projection of the air output channel on the plane is in a range of 1/10-1/2.

18. A method for controlling the air conditioner according to claim 17 comprising:

determining a current operation mode of the air conditioner;

controlling the opening-closing mechanism to open the air regulation channel area in response to determining that the current operation mode is a cooling mode; and controlling the opening-closing mechanism to close the air regulation channel area in response to determining that the current operation mode is a heating mode.

19. The method according to claim 18, wherein:

the opening-closing mechanism is a first opening-closing mechanism and the air regulation channel area is a first air regulation channel area;

the housing further includes a third air outlet located below the second air outlet; and the air output door assembly further comprises a second opening-closing mechanism movably arranged at the air output door assembly and configured to open or close a second air regulation channel area that includes a lower part of the air output channel;

the method further comprising:

in response to determining that the current operation mode is the cooling mode, further controlling the second opening-closing mechanism to close the second air regulation channel area; and in response to determining that the current operation mode is the heating mode, further controlling the second opening-closing mechanism to open the second air regulation channel area.

* * * * *